US012637730B2

(12) United States Patent
Hirashima et al.

(10) Patent No.: US 12,637,730 B2
(45) Date of Patent: *May 26, 2026

(54) STEEL SHEET, MEMBER, AND METHODS FOR PRODUCING THE SAME

(71) Applicant: JFE Steel Corporation, Tokyo (JP)

(72) Inventors: Takuya Hirashima, Tokyo (JP); Shimpei Yoshioka, Tokyo (JP); Shinjiro Kaneko, Tokyo (JP); Soshi Yoshimoto, Tokyo (JP); Tomohiro Hashimukai, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 986 days.

This patent is subject to a terminal disclaimer.

(21) Appl. No.: 17/769,835

(22) PCT Filed: Oct. 23, 2020

(86) PCT No.: PCT/JP2020/039951

§ 371 (c)(1),
(2) Date: Apr. 18, 2022

(87) PCT Pub. No.: WO2021/085336

PCT Pub. Date: May 6, 2021

(65) Prior Publication Data

US 2022/0372590 A1 Nov. 24, 2022

(30) Foreign Application Priority Data

Oct. 31, 2019 (JP) ..... 2019-198935

(51) Int. Cl.
*C21D 9/46* (2006.01)
*C21D 1/18* (2006.01)
(Continued)

(52) U.S. Cl.
CPC ..... *C21D 9/46* (2013.01); *C21D 1/18* (2013.01); *C21D 6/001* (2013.01); *C21D 6/002* (2013.01);
(Continued)

(58) Field of Classification Search
None
See application file for complete search history.

(56) References Cited

U.S. PATENT DOCUMENTS 12,146,204 B2 * 11/2024 Hirashima ..... C21D 6/005
2012/0222781 A1 9/2012 Azuma et al.
(Continued)

FOREIGN PATENT DOCUMENTS

CN 105074040 A 11/2015
JP 462733 B1 1/1971
(Continued)

OTHER PUBLICATIONS

Chinese Office Action for Chinese Application No. 202080073433.3, dated Jun. 27, 2023 with Concise Statement of Relevance of Office Action, 8 pages.
(Continued)

*Primary Examiner* — Anthony M Liang
(74) *Attorney, Agent, or Firm* — Buchanan Ingersoll & Rooney PC

(57) ABSTRACT

The steel sheet of the present invention has a steel microstructure containing, in area fraction, martensite: from 20% to 100%, ferrite: from 0% to 80%, and another metal phase: 5% or less, and in which a ratio of a dislocation density in metal phases on a surface of the steel sheet to a dislocation density in the metal phases in a thicknesswise central portion of the steel sheet is from 30% to 80%. The maximum
(Continued)

amount of warpage of the steel sheet when the steel sheet is sheared to a length of 1 m in a rolling direction is 15 mm or less.

14 Claims, 2 Drawing Sheets

(51) Int. Cl.

| | |
|---|---|
| ***C21D 6/00*** | (2006.01) |
| ***C21D 8/02*** | (2026.01) |
| ***C21D 8/0221*** | (2026.01) |
| ***C22C 38/00*** | (2006.01) |
| ***C22C 38/02*** | (2006.01) |
| ***C22C 38/06*** | (2006.01) |
| ***C22C 38/08*** | (2006.01) |
| ***C22C 38/14*** | (2006.01) |
| ***C22C 38/22*** | (2006.01) |
| ***C22C 38/24*** | (2006.01) |
| ***C22C 38/32*** | (2006.01) |
| ***C22C 38/38*** | (2006.01) |

(52) U.S. Cl.

CPC ..... *C21D 6/005* (2013.01); *C21D 6/008* (2013.01); *C21D 8/02* (2013.01); *C21D 8/0226* (2013.01); *C21D 8/0236* (2013.01); *C22C 38/001* (2013.01); *C22C 38/002* (2013.01); *C22C 38/008* (2013.01); *C22C 38/02* (2013.01); *C22C 38/06* (2013.01); *C22C 38/08* (2013.01); *C22C 38/14* (2013.01); *C22C 38/22* (2013.01); *C22C 38/24* (2013.01); *C22C 38/32* (2013.01); *C22C 38/38* (2013.01); *C21D 2211/008* (2013.01)

(56) References Cited

U.S. PATENT DOCUMENTS

| | | | |
|---|---|---|---|
| 2015/0368742 | A1 | 12/2015 | Shibata et al. |
| 2017/0327926 | A1 | 11/2017 | Yoshimoto et al. |
| 2019/0010564 | A1 | 1/2019 | Yoshimoto et al. |
| 2021/0062288 | A1 | 3/2021 | Nishio et al. |
| 2021/0310092 | A1 | 10/2021 | Kohsaka et al. |

FOREIGN PATENT DOCUMENTS

| | | | | |
|---|---|---|---|---|
| JP | 08176884 | A | | 7/1996 |
| JP | 2002322537 | A | | 11/2002 |
| JP | 3374659 | B2 | | 2/2003 |
| JP | 2006104546 | A | | 4/2006 |
| JP | 2010090432 | A | * | 4/2010 |
| JP | 2013104081 | A | | 5/2013 |
| JP | 6094722 | B2 | | 3/2017 |
| JP | 2017119912 | A | | 7/2017 |
| JP | 2020019992 | A | | 2/2020 |
| WO | 2019181950 | A1 | | 9/2019 |
| WO | 2020026838 | A1 | | 2/2020 |

OTHER PUBLICATIONS

Extended European Search Report for EP Application No. 20881194.3, dated Oct. 10, 2022, 10 pages.

International Search Report and Written Opinion for International Application No. PCT/JP2020/039951, dated Dec. 28, 2020, 6 pages.

Chinese Office Action with Search Report for Chinese Application No. 202080073433.3, dated Sep. 2, 2022, 11 pages.

* cited by examiner

STEEL SHEET, MEMBER, AND METHODS FOR PRODUCING THE SAME

CROSS REFERENCE TO RELATED APPLICATIONS

This is the U.S. National Phase application of PCT/JP2020/039951 filed Oct. 23, 2020 which claims priority to Japanese Patent Application No. 2019-198935, filed Oct. 31, 2019, the disclosures of these applications being incorporated herein by reference in their entireties for all purposes.

FIELD OF THE INVENTION

The present invention relates to a steel sheet used preferably for automotive parts etc., to a member, and to methods for producing the same. More particularly, the invention relates to a steel sheet having high strength, excellent shape uniformity, and excellent delayed fracture resistance, to a member, and to methods for producing the same.

BACKGROUND OF THE INVENTION

In recent years, from the viewpoint of global environmental conservation, the automobile industry as a whole is striving to improve the fuel efficiency of automobiles in order to reduce $CO_2$ emission. The most effective way to improve the fuel efficiency of automobiles is to reduce the weight of the automobiles by reducing the thicknesses of parts used. Therefore, in recent years, the amount of high strength steel sheets used as materials of automotive parts is increasing.

To obtain sufficient steel sheet strength, many steel sheets utilize martensite, which is a hard phase. However, when martensite is formed, the uniformity of the sheet shape deteriorates due to transformation strain. The deterioration in the uniformity of the sheet shape adversely affects dimensional accuracy during forming. Therefore, steel sheets are subjected to straightening such as levelling or skin pass rolling (temper rolling) in order to obtain desired dimensional accuracy. However, when strain is introduced by the levelling or skin pass rolling, dimensional accuracy during forming deteriorates, and the desired dimensional accuracy is not obtained. To improve the dimensional accuracy, it is necessary to prevent deterioration in the uniformity of the sheet shape during martensite transformation, and various techniques have been proposed.

For example, in Patent Literature 1, the area fraction of ferrite and the area fraction of martensite are controlled to improve the shape and delayed fracture resistance. Specifically, Patent Literature 1 provides an ultrahigh-strength steel sheet composed of multi-phase steel having a metal microstructure containing a tempered martensite phase at a volume fraction of 50 to 80% and a ferrite phase at a volume fraction of 20 to 50%. With this microstructure, intrusion of hydrogen can be reduced, and the steel sheet can have a good shape and good delayed fracture resistance.

Patent Literature 2 provides a technique for preventing deterioration in the shape of a steel sheet caused by martensite transformation during water quenching by restraining the steel sheet by rolls in water.

PATENT LITERATURE

PTL 1: Japanese Unexamined Patent Application Publication No. 2010-90432

PTL 2: Japanese Patent No. 6094722

SUMMARY OF THE INVENTION

Steel sheets used for automobile bodies are subjected to press working before use, and therefore good shape uniformity is their essential property. In recent years, the amount of high-strength steel sheets used as the materials of automotive parts is increasing, and it is necessary that the delayed fracture resistance, which is a concern associated with strengthening, be good. It is therefore necessary for the steel sheets to have high strength, a good shape, and excellent delayed fracture resistance.

With the technique disclosed in Patent Literature 1, the microstructure is controlled to obtain a good shape and excellent delayed fracture resistance. However, with the technique provided, the shape deteriorates due to transformation expansion during martensite transformation, and therefore the shape improving effect may be poorer than that in aspects of the present invention.

With the technique disclosed in Patent Literature 2, the shape uniformity can be improved. However, with the technique provided, good delayed fracture resistance is not obtained.

It is an object according to aspects of the present invention to provide a high-strength steel sheet having excellent shape uniformity and excellent delayed fracture resistance and also provide a member and methods for producing the same.

The term "high strength" means that the tensile strength TS in a tensile test performed at a strain rate of 10 mm/minute according to JIS Z2241 (2011) is 750 MPa or higher.

The term "excellent shape uniformity" means that the maximum amount of warpage of the steel sheet sheared to a length of 1 m in the rolling direction is 15 mm or less.

The term "excellent delayed fracture resistance" means as follows. Formed products prepared by bending under different load stresses are immersed in hydrochloric acid with pH=1 (25° C.) for 96 hours. When no cracking is found after the immersion, it can be judged that no delayed fracture will occur. The maximum load stress that does not cause cracking is defined as a critical load stress. The critical load stress is compared with a yield strength YS in a tensile test performed at a strain rate of 10 mm/minute according to JIS Z2241 (2011). When the critical load stress the YS, the delayed fracture resistance is considered to be excellent.

To solve the foregoing problems, the present inventors have conducted extensive studies on the requirements for a steel sheet having a tensile strength of 750 MPa or more, a good steel sheet shape, and good delayed fracture resistance. The inventors have found that, to obtain a steel sheet with a good shape and good delayed fracture resistance, it is necessary that a ratio of a dislocation density in metal phases on a surface of the steel sheet to a dislocation density in the metal phases in a thicknesswise central portion of the sheet be from 30% to 80%. The inventors have also found that, when the volume fraction of martensite formed by rapid cooling is 20% or more, high strength is obtained. Since the martensite transformation during water cooling proceeds rapidly and nonuniformly, the transformation strain causes deterioration in the shape uniformity. The inventors have examined how to reduce the adverse effect due to the transformation strain and found that the shape uniformity of a sheet is improved by applying restraining force to the front and back sides of the sheet during martensite transformation. The inventors have also found that, by controlling the restraining conditions, the ratio of the dislocation density in the metal phases on the surface of the steel sheet to the dislocation density in the metal phases in the thicknesswise central portion of the sheet can be reduced and that the delayed fracture resistance is improved.

As described above, the present inventors have conducted various studies to solve the foregoing problems and found that a high-strength steel sheet having excellent delayed fracture resistance can be obtained, and thus aspects of the present invention have been completed. Aspects of the present invention are summarized as follows.

[1] A steel sheet having a steel microstructure which contains:

in area fraction, martensite: from 20% to 100%, ferrite: from 0% to 80%, and another metal phase: 5% or less; and in which a ratio of a dislocation density in metal phases on a surface of the steel sheet to a dislocation density in the metal phases in a thicknesswise central portion of the steel sheet is from 30% to 80%, wherein the maximum amount of warpage of the steel sheet when the steel sheet is sheared to a length of 1 m in a rolling direction is 15 mm or less.

[2] The steel sheet according to [1], which has a chemical composition containing, in mass %, C: from 0.05% to 0.60%, Si: from 0.01% to 2.0%, Mn: from 0.1% to 3.2%, P: 0.050% or less, S: 0.0050% or less, Al: from 0.005% to 0.10%, and N: 0.010% or less, with the balance being Fe and incidental impurities.

[3] The steel sheet according to [2], in which the chemical composition further contains, in mass %, at least one selected from Cr: 0.20% or less, Mo: less than 0.15%, and V: 0.05% or less.

[4] The steel sheet according to [2] or [3], in which the chemical composition further contains, in mass %, at least one selected from Nb: 0.020% or less and Ti: 0.020% or less.

[5] The steel sheet according to any one of [2] to [4], in which the chemical composition further contains, in mass %, at least one selected from Cu: 0.20% or less and Ni: 0.10% or less.

[6] The steel sheet according to any one of [2] to [5], in which the chemical composition further contains, in mass %, B: less than 0.0020%.

[7] The steel sheet according to any one of [2] to [6], in which the chemical composition further contains, in mass %, at least one selected from Sb: 0.1% or less and Sn: 0.1% or less.

[8] A member which is prepared by subjecting the steel sheet according to any one of [1] to [7] to at least one of forming and welding.

[9] A method for producing a steel sheet, which includes:

a hot rolling step of heating a steel slab having the chemical composition according to any one of [2] to [7] and then hot-rolling the steel slab; and an annealing step of holding a hot-rolled steel sheet obtained in the hot rolling step at an annealing temperature equal to or higher than $A_{C1}$ temperature for 30 seconds or longer, then starting water quenching the hot-rolled steel sheet from a temperature equal to or higher than Ms temperature including water cooling to 100° C. or lower, and reheating the hot-rolled steel sheet to from 100° C. to 300° C., in which, in a region in which a surface temperature of the steel sheet is equal to or lower than (Ms temperature+150° C.) during the water cooling in the water quenching in the annealing step, the steel sheet is restrained from front and back sides of the steel sheet using two rolls such that the following conditions (1) to (3) are satisfied, the two rolls being disposed with the steel sheet interposed therebetween:

(1) a depression amount of each of the two rolls is more than t mm and (t×2.5) mm or less, where t is a thickness of the steel sheet;

(2) Rn and rn are from 50 mm to 1000 mm, where Rn and rn are roll diameters of the respective two rolls; and (3) an inter-roll distance between the two rolls is more than (Rn+rn+t)/16 mm and (Rn+rn+t)/1.2 mm or less.

[10] A method for producing a steel sheet, which includes:

a hot rolling step of heating a steel slab having the chemical composition according to any one of [2] to [7] and then hot-rolling the steel slab;

a cold rolling step of cold-rolling a hot-rolled steel sheet obtained in the hot rolling step; and an annealing step of holding a cold-rolled steel sheet obtained in the cold rolling step at an annealing temperature equal to or higher than $A_{C1}$ temperature for 30 seconds or longer, then starting water quenching the cold-rolled steel sheet from a temperature equal to or higher than Ms temperature including water cooling to 100° C. or lower, and reheating the cold-rolled steel sheet to from 100° C. to 300° C., in which, in a region in which a surface temperature of the steel sheet is equal to or lower than (Ms temperature+150° C.) during the water cooling in the water quenching in the annealing step, the steel sheet is restrained from front and back sides of the steel sheet using two rolls such that the following conditions (1) to (3) are satisfied, the two rolls being disposed with the steel sheet interposed therebetween:

(1) a depression amount of each of the two rolls is more than t mm and (t×2.5) mm or less, where t is a thickness of the steel sheet;

(2) Rn and rn are from 50 mm to 1000 mm, where Rn and rn are roll diameters of the respective two rolls; and (3) an inter-roll distance between the two rolls is more than (Rn+rn+t)/16 mm and (Rn+rn+t)/1.2 mm or less.

[11] A method for producing a member, which includes a step of subjecting the steel sheet produced by the steel sheet production method according to [9] or [10] to at least one of forming and welding.

Aspects of the present invention can provide a high-strength steel sheet having excellent shape uniformity and excellent delayed fracture resistance and can also provide a member and methods for producing the same.

By applying the steel sheet according to aspects of the present invention to a structural member of an automobile, the steel sheet for the automobile can have both high strength and improved delayed fracture resistance. Specifically, aspects of the present invention can improve the performance of the automobile body.

DETAILED DESCRIPTION OF EMBODIMENTS OF THE INVENTION

Figure 1:
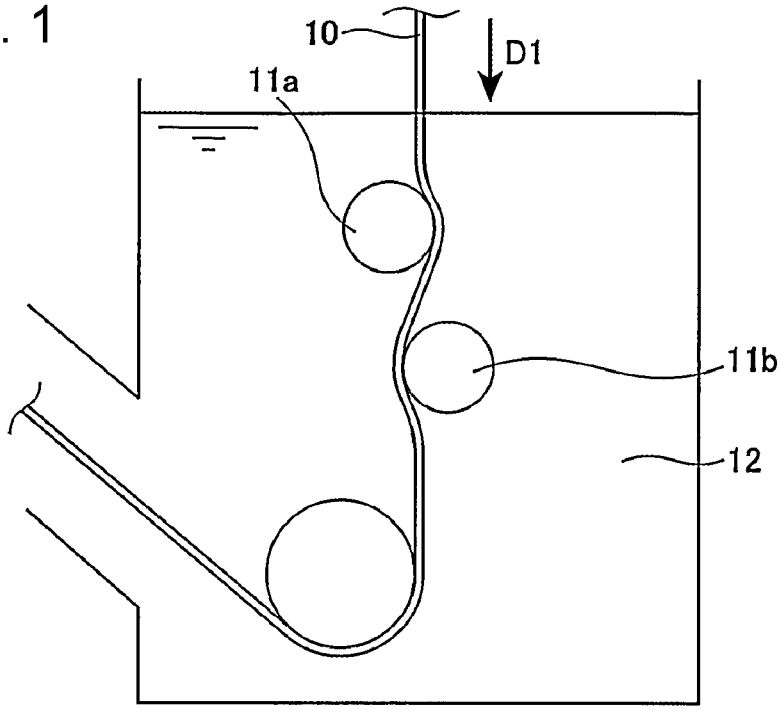
FIG. 1 is a schematic illustration of an example of a steel sheet restrained by two rolls from the front and back side of the steel sheet during water cooling in an annealing step.

Embodiments of the present invention will next be described. However, the present invention is not limited to the following embodiments.

The steel sheet according to aspects of the present invention has a microstructure containing, in area fraction, martensite: from 20% to 100%, ferrite: from 0% to 80%, and other metal phases: 5% or less, and in which a ratio of a dislocation density in metal phases on a surface of the steel sheet to a dislocation density in the metal phases in a thicknesswise central portion of the steel sheet is from 30% to 80%. The maximum amount of warpage of the steel sheet when the steel sheet is sheared to a length of 1 m in a rolling direction is 15 mm or less. With the steel sheet satisfying the above conditions, the effects according to aspects of the invention can be obtained. Therefore, no particular limitation is imposed on the chemical composition of the steel sheet.

First, the steel microstructure of the steel sheet according to aspects of the present invention will be described. "%" for martensite, ferrite, and other metal phases in the following description of the steel microstructure means the "area fraction (%) based on the total area of the steel microstructure of the steel sheet."

Martensite: From 20% to 100%

To obtain high strength, i.e., TS≥750 MPa, the area fraction of martensite based on the total area of the microstructure is 20% or more. If the area fraction of martensite is less than 20%, the amount of any of ferrite, retained austenite, pearlite, and bainite increases, and the strength is reduced. The total area fraction of martensite based on the total area of the microstructure may be 100%. The area fraction of martensite is the sum of the area fraction of fresh martensite that is as-quenched martensite and the area fraction of tempered martensite subjected to tempering. In accordance with aspects of the present invention, the martensite is a hard microstructure generated from austenite at a temperature equal to or lower than the martensite transformation start temperature (simply referred to also as Ms temperature), and the tempered martensite is a microstructure obtained by reheating and tempering the martensite.

Ferrite: From 0% to 80%

From the viewpoint of maintaining sufficient strength, the area fraction of ferrite based on the total area of the steel microstructure of the steel sheet is 80% or less. The area fraction may be 0%. In accordance with aspects of the present invention, the ferrite is a microstructure formed by transformation from austenite at a relatively high temperature and forming bcc crystal grains.

Other Metal Phases: 5% or Less

The steel microstructure of the steel sheet according to aspects of the present invention may contain incidental metal phases other than the martensite and ferrite. The allowable area fraction of the other metal phases is 5% or less. The other metal phases include retained austenite, pearlite, bainite, etc. The area fraction of the other metal phases may be 0%. The retained austenite is austenite that has not undergone martensite transformation and remains at room temperature. The pearlite is a microstructure composed of ferrite and acicular cementite. The bainite is a hard microstructure formed from austenite at a relatively low temperature (equal to or higher than the martensite transformation start temperature) and including acicular or plate-shaped ferrite and carbides dispersed therein.

Values measured by a method described in Examples are used as the values of the area fractions of the microstructures in the steel microstructure.

Specifically, first, a test sample is taken from a steel sheet so as to extend in the rolling direction of the steel sheet and a direction perpendicular to the rolling direction, and a cross section along the sheet thickness L and parallel to the rolling direction is polished to a mirror finish and etched with a nital solution to cause the microstructure to appear. The sample with the microstructure appearing therein is observed using a scanning electron microscope. A 16×15 lattice with a spacing of 4.8 μm is placed on a region with actual lengths of 82 μm×57 μm in an SEM image at a magnification of 1500×, and the area fraction of martensite is examined using a point counting method in which the number of points on each phase is counted. The area fraction is the average of three area fractions determined in different SEM images at a magnifications of 1500×. The measurement is performed at a depth of one-fourth the sheet thickness. Martensite is a white microstructure, and tempered martensite includes fine carbides precipitated therein. Ferrite is a black microstructure. Depending on the plane orientations of block grains and the degree of etching, internal carbides may be less likely to appear. In such a case, it is necessary to perform etching sufficiently to check the internal carbides.

The area fraction of the metal phases other than ferrite and martensite is computed by subtracting the total area fraction of ferrite and martensite from 100%.

Ratio of Dislocation Density in Metal Phases on Surface of Steel Sheet to Dislocation Density in Metal Phases in Thicknesswise Central Portion of Sheet: From 30% to 80%

If the ratio of the dislocation density in the metal phases on the surface of the steel sheet to the dislocation density in the metal phases in the thicknesswise central portion of the sheet (the dislocation density in the metal phases on the surface of the steel sheet/the dislocation density in the metal phases in the thicknesswise central portion of the sheet) is large, a difference in strain occurs between the surface and the thicknesswise center of the sheet when the sheet is sheared or subjected to working, and cracks occur at boundaries in a delayed fracture test. Therefore, the dislocation density ratio must be controlled strictly. The ratio of the dislocation density in the metal phases on the surface of the steel sheet to the dislocation density in the metal phases in the thicknesswise central portion of the sheet must be 80% or less. This ratio is preferably 75% or less and more preferably 70% or less. If the ratio of the dislocation density in the metal phases on the surface of the steel sheet to the dislocation density in the metal phases in the thicknesswise central portion of the sheet is excessively small, a large amount of strain is introduced into the surface when the sheet is sheared or subjected to working. In this case, the dislocation density in the metal phases on the surface relative to the dislocation density in the thicknesswise central portion of the sheet increases, and therefore the delayed fracture resistance deteriorates. Therefore, the ratio of the dislocation density in the metal phases on the surface of the steel sheet to the dislocation density in the metal phases in the thicknesswise central portion of the sheet is 30% or more. This ratio is preferably 40% or more and more preferably 50% or more.

In accordance with aspects of the present invention, the surface of the steel sheet on which the dislocation density is determined is meant to encompass both the front and back surfaces of the steel sheet (one surface and the other surface opposite thereto).

A value obtained by a method described in Examples is used as the ratio of the dislocation density in the metal phases on the surface of the steel sheet to the dislocation density in the metal phases in the thicknesswise central portion of the sheet.

Specifically, first, when the dislocation density in the metal phases in the thicknesswise central portion of a steel sheet is measured, a sample with a width of 20 mm×a conveying direction length of 20 mm is taken from a widthwise central portion of the steel sheet and ground to a depth of one-half the thickness of the sheet. Then the thicknesswise central portion of the sheet is subjected to X-ray diffraction measurement. The amount of the steel sheet polished to remove scales is less than 1 μm. The radiation source is Co. Since the analysis depth of Co is about 20 μm, the dislocation density in the metal phases is the dislocation density in the metal phases in the range of 0 to 20 μm from the measurement surface. The dislocation density in the metal phases is determined using a method in which the dislocation density is converted from a strain determined using half widths β in the X-ray diffraction measurement. To extract the strain, the Williamson-Hall method described below is used. The half width is influenced by the size D of crystallites and the strain ε and can be computed as the sum of these factors using the following formula.

$$\beta=\beta 1+\beta 2=(0.9\lambda/(D\times\cos\theta))+2\varepsilon\times\tan\theta$$

By modifying this formula, $\beta\cos\theta/\lambda=0.9\lambda/D+2\varepsilon\times\sin\theta/\lambda$ is obtained. $\beta\cos\theta/\lambda$ is plotted versus $\sin\theta/\lambda$, and the strain ε is computed from the gradient of the straight line. The diffraction lines used for the computation are (110), (211), and (220). To convert the strain ε to the dislocation density in the metal phases, $\rho=14.4\varepsilon^2/b^2$ is used. θ is a peak angle computed using the θ-2θ method for X-ray diffraction, and λ is the wavelength of the X-ray used for the X-ray diffraction. b is the Burgers vector of Fe(α) and is 0.25 nm in accordance with aspects of the present invention.

In addition, the dislocation density in the metal phases on the surface of the steel sheet is measured using the same measurement method as above except that the sample is not ground and that the measurement position is changed from the thicknesswise central portion of the sheet to the surface of the steel sheet.

Then the ratio of the dislocation density in the metal phases on the surface of the steel sheet to the dislocation density in the thicknesswise central portion of the sheet is determined.

The ratio of the dislocation density in the metal phases on the surface of the steel sheet to the dislocation density in the metal phases in the thicknesswise central portion of the sheet at the widthwise central portion of the sheet is the same as those at widthwise edges of the sheet. Therefore, in accordance with aspects of the present invention, the dislocation density in the metal phases at the widthwise central portion of the sheet is measured and used for evaluation.

Next, the properties of the steel sheet according to aspects of the present invention will be described.

The strength of the steel sheet according to aspects of the present invention is high. Specifically, as described in Examples, the tensile strength determined by a tensile test performed at a strain rate of 10 mm/minutes according to JIS Z2241 (2011) is 750 MPa or more. The tensile strength is preferably 950 MPa or more, more preferably 1150 MPa or more, and still more preferably 1300 MPa or more. No particular limitation is imposed on the upper limit of the tensile strength. However, from the viewpoint of ease of achieving balance between the tensile strength and other properties, the tensile strength is preferably 2500 MPa or lower.

The steel sheet according to aspects of the present invention has excellent delayed fracture resistance. Specifically, the critical load stress determined by the delayed fracture test described in Examples is equal to or higher than the YS. More specifically, formed products prepared by bending under different load stresses are immersed in hydrochloric acid with pH=1 (25° C.) for 96 hours. When no cracking is found after the immersion, it can be judged that no delayed fracture will occur. The maximum load stress that does not cause cracking is defined as the critical load stress. The yield strength YS is obtained using a tensile test performed at a strain rate of 10 mm/minute according to JIS Z2241 (2011). The critical load stress is preferably (the YS+100 MPa) or more and more preferably (the YS+200 MPa) or more.

The steel sheet according to aspects of the present invention has excellent shape uniformity. Specifically, the maximum amount of warpage of the steel sheet when the steel sheet is sheared to a length of 1 m in the rolling direction (longitudinal direction) of the steel sheet is 15 mm or less. The maximum amount of warpage is preferably 10 mm or less and more preferably 8 mm or less. No limitation is imposed on the lower limit of the maximum amount of warpage, and the maximum amount of warpage is most preferably 0 mm.

The phrase "the maximum amount of warpage of the steel sheet when the steel sheet is sheared to a length of 1 m in the longitudinal direction" as used herein means as follows. The steel sheet is sheared to a length of 1 m in the steel sheet longitudinal direction (rolling direction) while the original width of the steel sheet is maintained. Then the sheared steel sheet is placed on a horizontal table. The distance from the horizontal table to the steel sheet at a position at which the gap between the horizontal table and a lower portion of the steel sheet is largest is used as the maximum amount of warpage. The above distance is the distance in a direction perpendicular to a horizontal surface of the horizontal table (the vertical direction). After the measurement of the amount of warpage with one surface of the steel sheet facing upward, the amount of warpage is measured with the other surface of the steel sheet facing upward, and the largest one of the measured warpage amounts is used as the maximum amount of warpage. The sheared steel sheet is placed on the horizontal table such that the horizontal table and the steel sheet are in contact with each other at as many corner portions of the steel sheet as possible (at two or more corner portions). The amount of warpage is determined by lowering a horizontal plate from a position higher than the steel sheet until the horizontal plate comes into contact with the steel sheet and subtracting the thickness of the steel sheet from the distance between the horizontal table and the horizontal plate at the contact position at which the horizontal plate is in contact with the steel sheet. When the steel sheet is sheared in the longitudinal direction, the clearance between the cutting edges of the shearing machine is set to 4% (the upper limit of the control range is 10%).

From the viewpoint of obtaining the effects according to aspects of the invention effectively, the thickness of the steel sheet according to aspects of the present invention is preferably from 0.2 mm to 3.2 mm.

Next, a description will be given of a preferred chemical composition for obtaining the steel sheet according to aspects of the present invention. In the following description of the chemical composition, "%" used as the unit of the content of a component means "% by mass."

C: From 0.05% to 0.60%

C is an element that improves the hardenability. When C is contained, a prescribed area fraction of martensite can be easily obtained. Moreover, when C is contained, the strength of martensite is increased, and sufficient strength can be easily obtained. From the viewpoint of obtaining prescribed strength while excellent delayed fracture resistance is maintained, the content of C is preferably 0.05% or more. From the viewpoint of achieving TS≥950 MPa, the content of C is more preferably 0.11% or more. From the viewpoint of achieving TS≥1150 MPa, the content of C is preferably 0.125% or more. However, if the content of C exceeds 0.60%, not only the strength tends to be excessively high, but also transformation expansion due to martensite transformation is not easily prevented. In this case, the shape uniformity tends to deteriorate. Therefore, the content of C is preferably 0.60% or less. The content of C is more preferably 0.50% or less and still more preferably 0.40% or less.

Si: From 0.01% to 2.0%

Si is an element for strengthening through solid solution strengthening. To obtain the above effect sufficiently, the content of Si is preferably 0.01% or more. The content of Si is more preferably 0.02% or more and still more preferably 0.03% or more. However, if the content of Si is excessively large, coarse MnS is likely to be formed in a thicknesswise central portion of the sheet. In this case, the dislocation density in the metal phases in the thicknesswise central portion of the sheet relative to the dislocation density on the surface of the steel sheet decreases, and the delayed fracture resistance tends to deteriorate. Therefore, the content of Si is preferably 2.0% or less, more preferably 1.7% or less, and still more preferably 1.5% or less.

Mn: From 0.1% to 3.2%

Mn is contained in order to improve the hardenability of the steel and to obtain a prescribed area fraction of martensite. If the content of Mn is less than 0.1%, ferrite is formed in a surface layer portion of the steel sheet, and the strength tends to decrease. Therefore, the content of Mn is preferably 0.1% or more, more preferably 0.2% or more, and still more preferably 0.3% or more. Moreover, Mn is an element that particularly facilitates the formation and coarsening of MnS. If the content of Mn exceeds 3.2%, coarse MnS tends to be formed in the thicknesswise central portion of the sheet. In this case, the dislocation density in the metal phases in the thicknesswise central portion of the sheet relative to the dislocation density on the surface of the steel sheet decreases, and the delayed fracture resistance tends to deteriorate. Therefore, the content of Mn is preferably 3.2% or less, more preferably 3.0% or less, and still more preferably 2.8% or less.

P: 0.050% or Less

P is an element that strengthens the steel. However, if the content of P is large, the occurrence of cracks is facilitated, and P tends to segregate at grain boundaries in the thicknesswise central portion of the sheet. In this case, the dislocation density in the metal phases in the thicknesswise central portion of the sheet relative to the dislocation density on the surface of the steel sheet decreases, and the delayed fracture resistance tends to deteriorate. Therefore, the content of P is preferably 0.050% or less, more preferably 0.030% or less, and still more preferably 0.010% or less. No particular limitation is imposed on the lower limit of the content of P. At present, the industrially achievable lower limit of P is about 0.003%.

S: 0.0050% or Less

S forms MnS, TiS, Ti(C, S), etc., and this is likely to cause the formation of coarse inclusions in the thicknesswise central portion of the sheet. In this case, the dislocation density in the metal phases in the thicknesswise central portion of the sheet relative to the dislocation density on the surface of the steel sheet decreases, and the delayed fracture resistance tends to deteriorate. To reduce the adverse effect of the inclusions, the content of S is preferably 0.0050% or less. The content of S is more preferably 0.0020% or less, still more preferably 0.0010% or less, and particularly preferably 0.0005% or less. No particular limitation is imposed on the lower limit of the content of S. At present, the industrially achievable lower limit of S is about 0.0002%.

Al: From 0.005% to 0.10%

Al is added to allow the steel to undergo deoxidization sufficiently to thereby reduce the amount of coarse inclusions in the steel. From the viewpoint of obtaining the effect of Al sufficiently, the content of Al is preferably 0.005% or more. The content of Al is more preferably 0.010% or more. If the content of Al exceeds 0.10%, carbides composed mainly of Fe such as cementite formed during coiling after hot rolling are unlikely to dissolve in an annealing step, and coarse inclusions and carbides tend to be formed. This easily causes not only a reduction in strength but also coarsening of the inclusions and carbides particularly in the thicknesswise central portion of the sheet. In this case, the dislocation density in the metal phases in the thicknesswise central portion of the sheet relative to the dislocation density on the surface of the steel sheet decreases, and the delayed fracture resistance tends to deteriorate. Therefore, the content of Al is preferably 0.10% or less, more preferably 0.08% or less, and still more preferably 0.06% or less.

N: 0.010% or Less

N is an element that forms nitrides such as TiN, (Nb, Ti)(C, N), and AlN and carbonitride-based coarse inclusions in the steel. The formation of these nitrides and inclusions causes the dislocation density in the metal phases in the thicknesswise central portion of the sheet relative to the dislocation density on the surface of the steel sheet to decrease, and the delayed fracture resistance tends to deteriorate. To prevent deterioration in the delayed fracture resistance, the content of N is preferably 0.010% or less. The content of N is more preferably 0.007% or less and still more preferably 0.005% or less. No particular limitation is imposed on the lower limit of the content of N. At present, the industrially achievable lower limit of N is about 0.0006%.

The steel sheet according to aspects of the present invention has a chemical composition containing the above components with the balance other than the above components being Fe (iron) and incidental impurities. Preferably, the steel sheet according to aspects of the present invention has a chemical composition containing the above components with the balance being Fe and incidental impurities. The steel sheet according to aspects of the present invention may contain the following allowable components (optional elements) so long as the operation according to aspects of the invention is not impaired.

At Least One Selected from Cr: 0.20% or Less, Mo: Less than 0.15%, and V: 0.05% or Less Cr, Mo, and V can be contained for the purpose of obtaining the effect of improving the hardenability of the steel. However, if the content of any of these elements is excessively large, their carbides coarsen. In this case, the dislocation density in the metal phases in the thicknesswise central portion of the sheet relative to the dislocation density on the surface of the steel sheet decreases, and the delayed fracture resistance deteriorates. Therefore, the content of Cr is preferably 0.20% or less and more preferably 0.15% or less. The content of Mo is preferably less than 0.15% and more preferably 0.10% or less. The content of V is preferably 0.05% or less, more preferably 0.04% or less, and still more preferably 0.03% or less. No particular limitation is imposed on the lower limit of the content of Cr and the lower limit of the content of Mo. However, from the viewpoint of obtaining the effect of improving the hardenability more effectively, the content of Cr and the content of Mo are each preferably 0.01% or more. The content of Cr and the content of Mo are each more preferably 0.02% or more and still more preferably 0.03% or more. No particular limitation is imposed on the lower limit of the content of V. However, from the viewpoint of obtaining the effect of improving the hardenability more effectively, the content of V is preferably 0.001% or more. The content of V is more preferably 0.002% or more and still more preferably 0.003% or more.

At Least One Selected from Nb: 0.020% or Less and Ti: 0.020% or Less

Nb and Ti contribute to strengthening through refinement of prior-γ grains. However, if large amounts of Nb and Ti are contained, the amount of Nb-based coarse precipitates such as NbN, Nb(C, N), and (Nb, Ti) (C, N) and Ti-based coarse precipitates such as TiN, Ti(C, N), Ti(C, S), and TiS that remain undissolved during slab heating in a hot rolling step increases. In this case, the dislocation density in the metal phases in the thicknesswise central portion of the sheet relative to the dislocation density on the surface of the steel sheet decreases, and the delayed fracture resistance deteriorates. Therefore, the content of Nb and the content of Ti are each preferably 0.020% or less, more preferably 0.015% or less, and still more preferably 0.010% or less. No particular limitation is imposed on the lower limit of the content of Nb and the lower limit of the content of Ti. However, from the viewpoint of obtaining the effect of increasing the strength more effectively, at least one of Nb and Ti is contained in an amount of 0.001% or more. The content of each of these elements is more preferably 0.002% or more and still more preferably 0.003% or more.

At Least One Selected from Cu: 0.20% or Less and Ni: 0.10% or Less

Cu and Ni have the effect of improving corrosion resistance in the use environment of automobiles and the effect of preventing intrusion of hydrogen into the steel sheet when their corrosion products cover the surface of the steel sheet. However, when the content of Cu and the content of Ni are excessively large, surface defects occur, and coatability and chemical conversion processability necessary for steel sheets for automobiles deteriorate. Therefore, the content of Cu is preferably 0.20% or less, more preferably 0.15% or less, and still more preferably 0.10% or less. The content of Ni is preferably 0.10% or less, more preferably 0.08% or less, and still more preferably 0.06% or less. No particular limitation is imposed on the lower limit of the content of Cu and the lower limit of the content of Ni. However, from the viewpoint of obtaining the effect of improving corrosion resistance and the effect of preventing intrusion of hydrogen more effectively, at least one of Cu and Ni is contained in an amount of preferably 0.001% or more and more preferably 0.002% or more.

B: Less than 0.0020%

B is an element that improves the hardenability of the steel. When B is contained, even if the content of Mn is small, the effect of forming martensite with a prescribed area fraction is obtained. However, if the content of B is 0.0020% or more, the dissolution rate of cementite during annealing slows down, and carbides composed mainly of Fe such as undissolved cementite remain present. Therefore, coarse inclusions and carbides are formed. In this case, the dislocation density in the metal phases in the thicknesswise central portion of the sheet relative to the dislocation density on the surface of the steel sheet decreases, and the delayed fracture resistance tends to deteriorate. Therefore, the content of B is preferably less than 0.0020%, more preferably 0.0015% or less, and still more preferably 0.0010% or less. No particular limitation is imposed on the lower limit of the content of B. However, from the viewpoint of obtaining the effect of improving the hardenability of the steel more effectively, the content of B is preferably 0.0001% or more, more preferably 0.0002% or more, and still more preferably 0.0003% or more. From the viewpoint of fixing N, it is preferable to add Ti in an amount of 0.0005% or more in combination with B.

At Least One Selected from Sb: 0.1% or Less and Sn: 0.1% or Less

Sb and Sn inhibit oxidation and nitriding of the surface layer portion of the steel sheet to thereby prevent a reduction in the amounts of C and B due to oxidation and nitriding of the surface layer portion of the steel sheet. Since the reduction in the amounts of C and B is prevented, the formation of ferrite in the surface layer portion of the steel sheet is inhibited, and this contributes to an increase in the strength. However, if any of the content of Sb and the content of Sn exceeds 0.1%, Sb and Sn segregate at prior-γ grain boundaries. In this case, the dislocation density in the metal phases in the thicknesswise central portion of the sheet relative to the dislocation density on the surface of the steel sheet decreases, and the delayed fracture resistance deteriorates. Therefore, each of the content of Sb and the content of Sn is preferably 0.1% or less. The content of Sb and the content of Sn are each more preferably 0.08% or less and still more preferably 0.06% or less. No particular limitation is imposed on the lower limit of the content of Sb and the lower limit of the content of Sn. However, from the viewpoint of obtaining the effect of increasing the strength more effectively, the content of each of Sb and Sn is preferably 0.002% or more. The content of Sb and the content of Sn are each more preferably 0.003% or more and still more preferably 0.004% or more.

The steel sheet according to aspects of the present invention may contain other elements including Ta, W, Ca, Mg, Zr, and REMs so long as the effects according to aspects of the invention are not impaired. The allowable content of each of these elements is 0.1% or less.

Next, a method for producing the steel sheet according to aspects of the present invention will be described.

The method for producing the steel sheet according to aspects of the present invention includes a hot rolling step, an optional cold rolling step, and an annealing step. One embodiment of the method for producing the steel sheet according to aspects of the present invention includes: the hot rolling step of heating a steel slab having the chemical composition described above and then hot-rolling the steel slab; the optional cold rolling step; and the annealing step of holding a hot-rolled steel sheet obtained in the hot rolling step or a cold-rolled steel sheet obtained in the cold rolling step at an annealing temperature equal to or higher than $A_{C1}$ temperature for 30 seconds or longer, then starting water quenching the resulting steel sheet from a temperature equal to or higher than Ms temperature including watercooling to 100° C. or lower, and reheating the cooled steel sheet to from 100° C. to 300° C. In a region in which the surface temperature of the steel sheet is equal to or lower than (Ms temperature+150° C.) during the water cooling in the water quenching in the annealing step, the steel sheet is restrained from the front and back sides of the steel sheet using two rolls such that the following conditions (1) to (3) are satisfied, the two rolls being disposed with the steel sheet interposed therebetween:

(1) the depression amount of each of the two rolls is more than t mm and (t×2.5) mm or less, where t is the thickness of the steel sheet;

(2) Rn and rn are from 50 mm to 1000 mm, where Rn and rn are the roll diameters of the respective two rolls; and (3) the inter-roll distance between the two rolls is more than (Rn+rn+t)/16 mm and (Rn+rn+t)/1.2 mm or less.

Each of the steps will next be described. The temperatures described below when the steel slab, the steel sheet, etc. are heated or cooled are the surface temperatures of the steel slab, the steel sheet, etc., unless otherwise specified.

Hot Rolling Step

The hot rolling step is the step of heating the steel slab having the chemical composition described above and then hot-rolling the heated steel slab.

The steel slab having the chemical composition described above is subjected to hot rolling. No particular limitation is imposed on the heating temperature of the slab. When the heating temperature is 1200° C. or higher, dissolution of sulfides is facilitated, and the degree of segregation of Mn is reduced. In this case, the amount of the coarse inclusions described above and the amount of the carbides are reduced, and the delayed fracture resistance is improved. Therefore, the heating temperature of the slab is preferably 1200° C. or higher. The heating temperature of the slab is more preferably 1230° C. or higher and still more preferably 1250° C. or higher. No particular limitation is imposed on the upper limit of the heating temperature of the slab, but the heating temperature is preferably 1400° C. or lower. No particular limitation is imposed on the heating rate when the slab is heated, but the heating rate is preferably 5 to 15° C./minute. No particular limitation is imposed on the soaking time of the slab when the slab is heated, but the soaking time is preferably 30 to 100 minutes.

The temperature of finish rolling is preferably 840° C. or higher. If the finish rolling temperature is lower than 840° C., it takes time for the temperature to drop, and inclusions and coarse carbides are formed. In this case, not only the delayed fracture resistance may deteriorate, but also the interior quality of the steel sheet may deteriorate. Therefore, the finish rolling temperature is preferably 840° C. or higher. The finish rolling temperature is more preferably 860° C. or higher. No particular limitation is imposed on the upper limit of the finish rolling temperature. However, to avoid difficulty in subsequent cooling to coiling temperature, the finish rolling temperature is preferably 950° C. or lower. The finish rolling temperature is more preferably 920° C. or lower.

Preferably, the hot-rolled steel sheet cooled to the coiling temperature is coiled at a temperature equal to or lower than 630° C. If the coiling temperature is higher than 630° C., the surface of the base iron may by decarburized. This may cause a difference in microstructure between the interior of the steel sheet and the surface of the steel sheet, and variations in alloy concentrations. Moreover, the decarburization may cause the formation of ferrite in the surface layer and a reduction in tensile strength may occur. Therefore, the coiling temperature is preferably 630° C. or lower. The coiling temperature is more preferably 600° C. or lower. No particular limitation is imposed on the lower limit of the coiling temperature. However, to prevent deterioration in cold rollability, the coiling temperature is preferably 500° C. or higher.

The coiled hot-rolled steel sheet may be pickled. No particular limitation is imposed on the pickling conditions.

Cold Rolling Step

The cold rolling step is the step of cold-rolling the hot-rolled steel sheet obtained in the hot rolling step. No particular limitation is imposed on the rolling reduction of the cold rolling and its upper limit. However, if the rolling reduction is less than 20%, the microstructure tends to be inhomogeneous. Therefore, the rolling reduction is preferably 20% or more. If the rolling reduction is more than 90%, excessively introduced strains facilitate recrystallization excessively during annealing. In this case, the diameter of prior-γ grains may increase, and the strength may deteriorate. Therefore, the rolling reduction is preferably 90% or less. The cold rolling step is not an essential step and may be omitted when the steel microstructure and the mechanical properties satisfy those for aspects of the present invention.

Annealing Step

The annealing step is the step of holding the cold-rolled steel sheet or the hot-rolled steel sheet at an annealing temperature equal to or higher than $A_{C1}$ temperature for 30 seconds or longer, then starting water quenching the resulting steel sheet from a temperature equal to or higher than Ms temperature including watercooling to 100° C. or lower, and reheating the cooled steel sheet to from 100° C. to 300° C. In a region in which the surface temperature of the steel sheet is equal to or lower than (Ms temperature+150° C.) during the water cooling in the water quenching, the steel sheet is restrained from the front and back sides of the steel sheet using two rolls such that the following conditions (1) to (3) are satisfied, the two rolls being disposed with the steel sheet interposed therebetween:

(1) the depression amount of each of the two rolls is more than t mm and (t×2.5) mm or less, where t is the thickness of the steel sheet;

(2) Rn and rn are from 50 mm to 1000 mm, where Rn and rn are the roll diameters of the respective two rolls; and (3) the inter-roll distance between the two rolls is more than (Rn+rn+t)/16 mm and (Rn+rn+t)/1.2 mm or less.

FIG. 1 shows a schematic illustration of an example of a steel sheet 10 that is restrained by two rolls from the front and back sides of the steel sheet during water cooling in the annealing step such that the above conditions (1) to (3) are satisfied. The two rolls are disposed such that one roll is disposed on the front side of the steel sheet 10 in cooling water 12 and the other roll is disposed on the back side. The steel sheet 10 is restrained by one roll 11*a* and the other roll 11*b* from the front and back sides. In FIG. 1, symbol D1 represents the conveying direction of the steel sheet.

Heating to Annealing Temperature Equal to or Higher than $A_{C1}$ Temperature

If the annealing temperature is lower than the $A_{C1}$ temperature, austenite is not formed. In this case, it is difficult to obtain a steel sheet containing 20% or more of martensite, and the desired strength is not obtained. Therefore, the annealing temperature is equal to or higher than the $A_{C1}$ temperature. The annealing temperature is preferably equal to or higher than (the $A_{C1}$ temperature+10° C.). No particular limitation is imposed on the upper limit of the annealing temperature. However, from the viewpoint of optimizing the temperature during water quenching and preventing deterioration in the shape uniformity, the annealing temperature is preferably 900° C. or lower.

The $A_{C1}$ temperature ($A_{C1}$ transformation temperature) as used herein is computed using the following formula. In the following formula, (%+symbol of element) means the content (% by mass) of the element.

$$A_{C1}(°\ C.)=723+22(\%\ Si)-18(\%\ Mn)+17(\%\ Cr)+4.5(\%\ Mo)+16(\%\ V)$$

Holding Time at Annealing Temperature: 30 Seconds or Longer

If the holding time at the annealing temperature is shorter than 30 second, dissolution of carbides and austenite transformation do not proceed sufficiently, and therefore remaining carbides coarsen during subsequent heat treatment. In this case, the dislocation density in the metal phases in the thicknesswise central portion of the sheet relative to the dislocation density on the surface of the steel sheet decreases, and the delayed fracture resistance deteriorates. Moreover, the desired volume fraction of martensite is not obtained, and the desired strength is not obtained. Therefore, the holding time at the annealing temperature is preferably 30 seconds or longer and preferably 35 seconds or longer. No particular limitation is imposed on the upper limit of the holding time at the annealing temperature. However, from the viewpoint of inhibiting an increase in the diameter of austenite grains and preventing deterioration in the delayed fracture resistance, the holding time at the annealing temperature is preferably 900 seconds or shorter.

Water Quenching Start Temperature: Ms Temperature or Higher

The quenching start temperature is an important factor that determines the volume fraction of martensite, which is a controlling factor of the strength. If the quenching start temperature is lower than Ms temperature, martensite transformation occurs before quenching, and self-tempering of martensite occurs before quenching. In this case, not only the shape uniformity deteriorates, but also ferrite transformation, pearlite transformation, and bainite transformation occur before quenching. As a result, the volume fraction of martensite decreases and the desired strength is difficult to obtain. Therefore, the water quenching temperature is equal to or higher than Ms temperature. The water quenching start temperature is preferably equal to or higher than (Ms temperature+50° C.). No particular limitation is imposed on the upper limit of the water quenching temperature, and the water quenching start temperature may be equal to the annealing temperature.

The Ms temperature as used herein is calculated using a formula below. In the following formula, (%+symbol of element) means the content (% by mass) of the element, and (% $V_M$) is the area fraction (unit: %) of martensite.

$$\text{Ms temperature}(°\ C.)=550-350((\%\ C)/(\%\ V_M)\times 100)-40(\%\ Mn)-17(\%\ Ni)-17(\%\ Cr)-21(\%\ Mo)$$

Restraining the steel sheet using the two rolls from the front and back sides of the steel sheet during water cooling in the water quenching is an important factor for obtaining the shape correction effect. Controlling the restraining conditions is an important factor for reducing the variations in the dislocation density in the metal phases in the thickness direction of the sheet. One feature according to aspects of the present invention is that, by restraining the steel sheet to correct the transformation strain generated during water cooling, the shape uniformity of the steel sheet is improved. Therefore, a correction using leveler straightening or skin pass rolling that increases variations in dislocation density in the metal phases and causes deterioration in the delayed fracture resistance is unnecessary. Since levelling or skin pass rolling used to correct shape deformation is unnecessary, variations in the dislocation density in the metal phases in the thickness direction of the steel sheet can be reduced.

The front and back sides as used herein are one surface of the steel sheet and its surface opposite thereto, and any one of them may be used as the front side.

Surface Temperature of Steel Sheet when Steel Sheet is Restrained Using Two Rolls from Front and Back Sides of Steel Sheet (Restraining Temperature): (Ms Temperature+150° C.) or Lower If the restraining temperature is higher than (Ms temperature+150° C.), martensite transformation occurs after the restraining. In this case, shape deterioration due to transformation expansion by the martensite transformation cannot be prevented, and the shape uniformity deteriorates. Therefore, the restraining temperature is (Ms temperature+150° C.) or lower, preferably (Ms temperature+100° C.) or lower, and more preferably (Ms temperature+50° C.) or lower. No particular limitation is imposed on the lower limit of the restraining temperature, and it is only necessary that the restraining temperature be 0° C. or higher at which water does not freeze.

Figure 2:
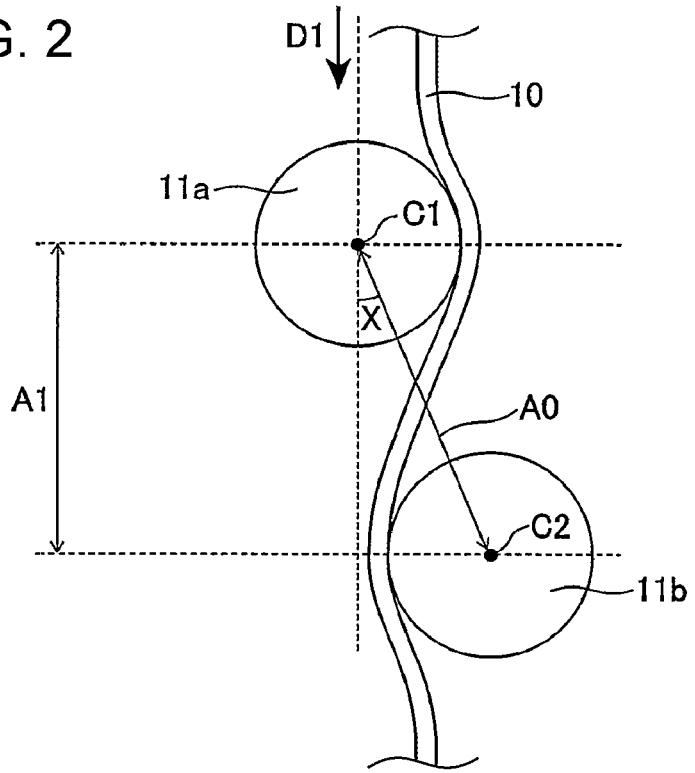
FIG. 2 is an enlarged illustration showing a portion near the two rolls in FIG. 1.
Figure 3:
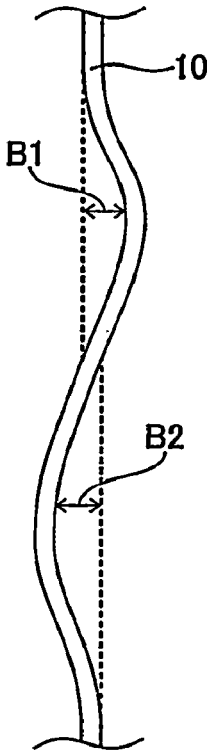
FIG. 3 is a schematic illustration showing the depression amounts of the rolls.

Depression Amount of Each of Two Rolls: More than t mm and (t×2.5) mm or Less, where t is Thickness of Steel Sheet FIG. 2 is an enlarged illustration showing a portion near the two rolls in FIG. 1. FIG. 3 is a schematic illustration showing the depression amounts of the rolls. For the convenience of description, only the steel sheet 10 in FIG. 2 is shown in FIG. 3.

As shown in FIGS. 2 and 3, the steel sheet 10 is depressed by the two rolls from the front and back sides. The depression amounts of the rolls as used herein are as follows. The depression amount of a roll in a state in which the roll is in contact with a straight steel sheet with no force applied to the steel sheet is set to 0. The amount (distance) of movement of the roll from the above state toward the steel sheet is used as the depression amount. In FIG. 3, the depression amount of one roll 11*a* and the depression amount of the other roll 11*b* are shown with respective symbols B1 and B2 assigned thereto.

In accordance with aspects of the present invention, the depression amount of each of the two rolls is more than t mm and (t×2.5) mm or less, where t is the thickness of the steel sheet. The two rolls are depressed onto the steel sheet from its front and back sides alternately to subject the steel sheet to bending-bending back treatment. In this manner, strain is introduced into the surface of the steel sheet on which the amount of strain is more likely to decrease than that in the thicknesswise center of the sheet, and therefore the ratio of the dislocation density in the metal phases on the surface of the steel sheet to the dislocation density in the metal phases in the thicknesswise central portion of the sheet can be reduced. Therefore, the depression amount of each of the rolls that restrain the steel sheet to perform the bending-bending back treatment is an important factor. To obtain the shape correction effect to reduce the ratio of the dislocation density in the metal phases on the surface of the steel sheet to the dislocation density in the metal phases in the thicknesswise central portion of the sheet, the depression amount must be more than t mm. The depression amount is preferably (t+0.1) mm or more. However, if the depression amount exceeds (t×2.5) mm, the amount of strain on the surface of the steel sheet becomes excessively large, and the delayed fracture resistance deteriorates. Therefore, the depression amount is (t×2.5) mm or less. The depression amount is preferably (t×2.0) mm or less.

No particular limitation is imposed on the barrel length of each of the two rolls so long as the depression amount is in the above range. However, to restrain the steel sheet by the two rolls stably from the front and back sides of the steel sheet, it is preferable that the barrel length of each of the two rolls is longer than the width of the steel sheet.

Rn and Rn: From 50 mm to 1000 mm, where Rn and Rn are Roll Diameters of Respective Two Rolls The area of contact between a roll and the steel sheet varies depending on the diameter of the roll. The larger the roll diameter, the higher the shape correction ability. To increase the shape correction ability to obtain the desired shape uniformity, the roll diameter must be 50 mm or more. The roll diameter is preferably 70 mm or more and more preferably 100 mm or more. A cooling nozzle cannot be disposed near the rolls. Therefore, if the roll diameter is excessively large, the cooling capacity near the rolls is low and the shape uniformity deteriorates. To obtain the cooling capacity that allows the desired shape uniformity, the roll diameter must be 1000 mm or less. The roll diameter is preferably 700 mm or less and more preferably 500 mm or less. The roll diameters of the two rolls may differ from each other so long as the desired shape uniformity is obtained.

Inter-Roll Distance Between Two Rolls: More than (Rn+rn+t)/16 mm and (Rn+rn+t)/1.2 mm or Less The inter-roll distance between the two rolls in accordance with aspects of the present invention is the center-to-center distance between the two rolls in the conveying direction (rolling direction) of the steel sheet. Let the center of the one roll 11*a* be C1, and the center of the other roll 11*b* be C2, as shown in FIG. 2. Then the distance between the center C1 and the center C2 in the conveying direction D1 of the steel sheet is the inter-roll distance A1.

More particularly, the inter-roll distance A1 is determined as A0·cos X, where A0 is the length of a line segment connecting the center C1 and the center C2 such that the length is shortest, and X is the angle between the line segment and the conveying direction D1.

Figure 4:
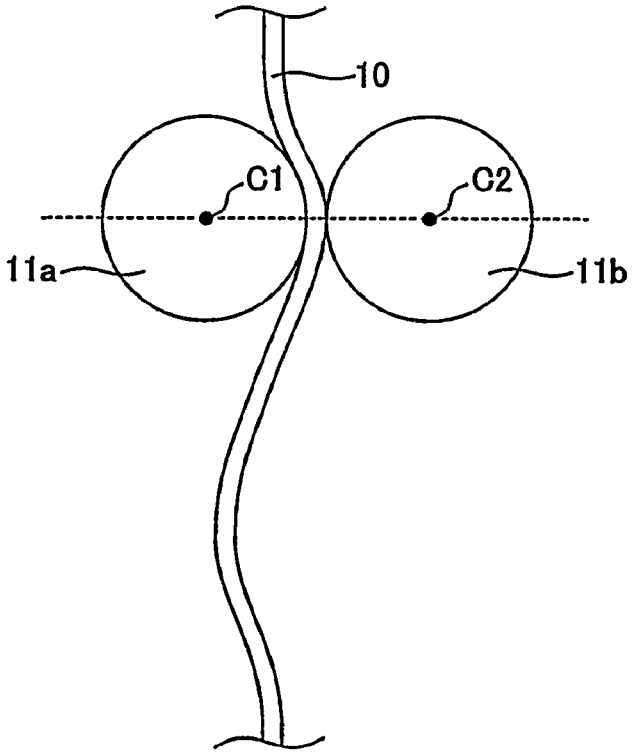
FIG. 4 is a schematic illustration showing the inter-roll distance between the two rolls.

If the two rolls sandwiching the steel sheet 10 therebetween are disposed such that the center C1 of the one roll 11*a* and the center C2 of the other roll 11*b* are located perpendicular to the steel sheet 10, the inter-roll distance is 0 mm, as shown in FIG. 4.

When the inter-roll distance is large, it is necessary to increase the depression amount in order to obtain the shape correction effect. However, if the depression amount is increased, a bending force is applied to the steel sheet. In this case, the ratio of the dislocation density in the metal phases on the surface of the steel sheet to the dislocation density in the metal phases in the thicknesswise central portion of the sheet can be reduced, and the delayed fracture resistance is improved. If the inter-roll distance is (Rn+rn+t)/16 mm or less, the pressing force acting on the steel sheet is large. Therefore, the amount of strain in the thicknesswise central portion of the sheet becomes excessively large, and the delayed fracture resistance deteriorates. Therefore, the inter-roll distance is more than (Rn+rn+t)/16 mm. The inter-roll distance is preferably (Rn+rn+t)/12 mm or more. If the inter-roll distance exceeds (Rn+rn+t)/1.2 mm, the effect of reducing the ratio of the dislocation density in the metal phases on the surface of the steel sheet to the dislocation density in the metal phases in the thicknesswise central portion of the sheet through bending decreases. Therefore, the inter-roll distance is (Rn+rn+t)/1.2 mm or less. The inter-roll distance is preferably (Rn+rn+t)/2 mm or less.

The number of rolls may be three of more so long as sufficient cooling capacity can be obtained and the desired shape uniformity and the desired delayed fracture resistance can be obtained. When the number of rolls is three or more, it is only necessary that the inter-roll distance between two rolls among the three or more rolls that are adjacent to each other in the rolling direction (longitudinal direction) of the steel sheet be (Rn+rn+t)/16 mm or less.

Water Cooling to 100° C. or Lower

If the temperature after water cooling is higher than 100° C., martensite transformation proceeds after the water cooling to the extent that the shape uniformity is adversely affected. Therefore, the temperature of the steel sheet after exit from the water bath must be 100° C. or lower and is preferably 80° C. or lower.

Reheating to from 100° C. to 300° C.

After the water cooling, the steel sheet is reheated to temper the martensite formed during the water cooling, and the strain introduced in the martensite can thereby be removed. As a result, the amount of strain is constant in the thickness direction of the sheet, and the variations in the dislocation density in the metal phases can be reduced, and the delayed fracture resistance can be improved. If the reheating temperature is lower than 100° C., the above effect is not obtained. Therefore, the reheating temperature is 100° C. or higher. The reheating temperature is preferably 130° C. or higher. If the steel sheet is tempered at higher than 300° C., transformation shrinkage due to tempering causes deterioration in the shape uniformity. Therefore, the reheating temperature is 300° C. or lower. The reheating temperature is preferably 260° C. or lower.

The hot-rolled steel sheet subjected to the hot rolling step may be subjected to heat treatment for softening the microstructure or may be subjected to temper rolling after the annealing step in order to adjust the shape. Moreover, the surface of the steel sheet may be plated with Zn, Al, etc.

Next, a member according to aspects of the present invention and a method for producing the member will be described.

A member according to aspects of the present invention is prepared by subjecting the steel sheet according to aspects of the present invention to at least one of forming and welding. The method for producing the member according to aspects of the present invention includes the step of subjecting the steel sheet produced by the steel sheet production method according to aspects of the present invention to at least one of forming and welding.

Since the steel sheet according to aspects of the present invention has high strength, excellent shape uniformity, and excellent delayed fracture resistance, the member obtained using the steel sheet according to aspects of the present invention has high strength, excellent shape uniformity, and excellent delayed fracture resistance. Therefore, the member according to aspects of the present invention can be preferably used, for example, for components required to have high strength, high shape uniformity, and high delayed fracture resistance. The member according to aspects of the present invention can be preferably used, for example, for automotive parts.

A general processing method such as press working can be used for the forming without any limitation. A general welding method such as spot welding or arc welding can be used for the welding.

EXAMPLES

Aspects of the present invention will be described specifically with reference to Examples.

Example 1

A 1.4 mm thick cold-rolled steel sheet obtained by cold rolling under conditions shown in Table 1 was annealed under conditions shown in Table 1 to thereby produce a steel sheet having properties described in Table 2. The temperature of the steel sheet when it passed between the restraining rolls was measured using a contact-type thermometer attached to one of the rolls. The two rolls were disposed such that the depression amounts of the two rolls were the same.

In the hot rolling before the cold rolling, the slab heating temperature of the steel slab was set to 1250° C., and the slab soaking time during the slab heating was set to 60 minutes. The finish rolling temperature was set to 880° C., and the coiling temperature was set to 550° C.

The $A_{C1}$ temperature of each steel sheet used was 706° C., and its Ms temperature was 410° C.

TABLE 1

| | | | Annealing conditions | | | | | | | | | | |
|---|---|---|---|---|---|---|---|---|---|---|---|---|---|
| No. | Cold rolling Rolling reduction % | Sheet thickness mm | Annealing temperature ° C. | Annealing holding time Seconds | Quenching start temperature ° C. | *1 ° C. | *2 mm | *3 mm | Roll diameter Rn mm | Roll diameter rn mm | Water cooling stop temperature ° C. | Reheating temperature ° C. | Remarks |
| 1 | 56 | 1.4 | 860 | 60 | 775 | 300 | 2.5 | 100 | 300 | 300 | 50 | 150 | Inventive Example |
| 2 | 56 | 1.4 | 860 | 60 | 782 | — | — | — | — | — | 50 | 150 | Comparative Example |
| 3 | 56 | 1.4 | 860 | 60 | 766 | 310 | 2.5 | 80 | 600 | 300 | 50 | 150 | Inventive Example |
| 4 | 56 | 1.4 | 860 | 60 | 769 | 305 | 2.5 | 30 | 300 | 500 | 50 | 150 | Comparative Example |
| 5 | 56 | 1.4 | 860 | 60 | 760 | 300 | 1.2 | 200 | 300 | 300 | 50 | 150 | Comparative Example |
| 6 | 56 | 1.4 | 860 | 60 | 776 | 300 | 1.6 | 400 | 300 | 300 | 50 | 120 | Inventive Example |
| 7 | 56 | 1.4 | 860 | 60 | 777 | 320 | 2.5 | 600 | 300 | 300 | 50 | 150 | Comparative Example |
| 8 | 56 | 1.4 | 860 | 60 | 780 | 320 | 2.5 | 200 | 300 | 300 | 50 | 70 | Comparative Example |

*1: The surface temperature of the steel sheet when it was restrained by the rolls.
*2: The depression amount of each of the two rolls.
*3: The inter-roll distance between the two rolls.

2. Evaluation Methods

For each of the steel sheets obtained under various production conditions, the steel microstructure was analyzed to examine microstructure fractions, and a tensile test was performed to evaluate tensile properties such as tensile strength. Moreover, a delayed fracture test was performed to evaluate the delayed fracture resistance, and the warpage of the steel sheet was used to evaluate the shape uniformity. X-ray diffraction measurement was performed to examine the dislocation density in the metal phases. The evaluation methods are as follows.

(Area Fraction of Martensite)

A test sample was taken from each steel sheet so as to extend in the rolling direction of the steel sheet and a direction perpendicular to the rolling direction, and a cross section along the sheet thickness L and parallel to the rolling direction was polished to a mirror finish and etched with a nital solution to cause the microstructure to appear. The sample with the microstructure appearing therein was observed using a scanning electron microscope. A 16×15 lattice with a spacing of 4.8 μm was placed on a region with actual lengths of 82 μm×57 μm in an SEM image at a magnification of 1500λ, and the area fraction of martensite was examined using a point counting method in which the number of points on each phase was counted. The area fraction was the average of three area fractions determined in different SEM images at a magnifications of 1500×. The measurement was performed at a depth of one-fourth the sheet thickness. Martensite is a white microstructure, and tempered martensite includes fine carbides precipitated therein. Ferrite is a black microstructure. Depending on the plane orientations of block grains and the degree of etching, internal carbides may be less likely to appear. In such a case, it is necessary to perform etching sufficiently to check the internal carbides.

The area fraction of the metal phases other than ferrite and martensite was computed by subtracting the total area fraction of ferrite and martensite from 100%.

(Tensile Test)

A JIS No. 5 test specimen having a gauge length of 50 mm and a gauge width of 25 mm and extending in the rolling direction was taken from the widthwise central portion of each steel sheet. A tensile test was performed at a strain rate of 10 mm/minute according to JIS Z2241 (2011) to thereby measure tensile strength (TS) and yield strength (YS).

(Delayed Fracture Test)

A delayed fracture test was performed to measure the critical load stress, and the delayed fracture resistance was evaluated using the critical load stress. Specifically, formed products prepared by bending under different load stresses were immersed in hydrochloric acid with pH=1 (25° C.). The maximum load stress that did not cause delayed fracture was defined as the critical load stress for evaluation. To judge the delayed fracture, a visual inspection was performed, and an enlarged image obtained under a stereoscopic microscope at a magnification of 20× was also used. When no cracking was found after immersion for 96 hours, it was considered that no breakage occurred. The term "cracking" as used herein means the occurrence of a crack having a crack length of 200 μm or more.

(Evaluation of Shape Uniformity of Steel Sheet)

Each steel sheet was sheared to a length of 1 m in the longitudinal direction (rolling direction) of the steel sheet while the original width of the steel sheet was maintained, and the sheared steel sheet was placed on a horizontal table. The sheared steel sheet was placed on the horizontal table such that the horizontal table and the steel sheet were in contact with each other at as many contact points as possible (at two or more points). The amount of warpage was determined by lowering a horizontal plate from a position higher than the steel sheet until the horizontal plate came into contact with the steel sheet and subtracting the thickness of the steel sheet from the distance between the horizontal table and the horizontal plate at the contact position at which the horizontal plate was in contact with the steel sheet. The above distance is the distance in a direction perpendicular to a horizontal surface of the horizontal table (the vertical direction). After the measurement of the amount of warpage with one surface of the steel sheet facing upward, the amount of warpage was measured with the other surface facing upward, and the largest one of the measured warpage amounts was used as the maximum amount of warpage. When the steel sheet was sheared, the clearance between the cutting edges of the shearing machine was set to 4% (the upper limit of the control range is 10%).

(Measurement of Dislocation Density in Metal Phases)

For each of the steel sheets, the ratio of dislocation density in the metal phases in the thickness direction of the sheet was measured by the following method.

When the dislocation density in the metal phases in the thicknesswise central portion of the steel sheet was measured, a sample having a width of 20 mm×a conveying direction length of 20 mm was taken from the widthwise central portion of the sheet and grounded to a depth of one-half the sheet thickness, and the thicknesswise central portion of the sheet was subjected to X-ray diffraction measurement. The amount of the steel sheet polished to remove scales was less than 1 μm. The radiation source was Co. Since the analysis depth of Co is about 20 μm, the dislocation density in the metal phases is the dislocation density in the metal phases in the range of 0 to 20 μm from the measurement surface. The dislocation density in the metal phases was determined using a method in which the dislocation density was converted from a strain determined from the half width β in the X-ray diffraction measurement. To extract the strain, the Williamson-Hall method described below was used. The half width is influenced by the size D of crystallites and the strain ε and can be computed as the sum of these factors using the following formula.

$$\beta=\beta 1+\beta 2=(0.9\lambda/(D\times\cos\theta))+2\varepsilon\times\tan\theta$$

By modifying this formula, $\beta\cos\theta/\lambda=0.9\lambda/D+2\varepsilon\times\sin\theta/\lambda$ is obtained. $\beta\cos\theta/\lambda$ was plotted versus $\sin\theta/\lambda$, and the strain ε was computed from the gradient of the straight line. The diffraction lines used for the computation were (110), (211), and (220). To convert the strain ε to the dislocation density in the metal phases, $\rho=14.4\varepsilon^2/b^2$ was used. Here, θ is a peak angle computed using the θ-2θ method for X-ray diffraction, and λ is the wavelength of the X-ray used for the X-ray diffraction. b is the Burgers vector of Fe(α) and is 0.25 nm in the present Example.

The dislocation density in the metal phases on the surface of the steel sheet was measured using the same measurement method as above except that the sample was not ground and that the measurement position was changed from the thicknesswise central portion of the sheet to the surface of the steel sheet.

Then the ratio of the dislocation density in the metal phases on the surface of the steel sheet to the dislocation density in the metal phases in the thicknesswise central portion of the sheet was determined.

The ratio of the dislocation density in the metal phases on the surface of the steel sheet to the dislocation density in the metal phases in the thicknesswise central portion of the sheet at the widthwise central portion of the sheet was the same as those at widthwise edges of the sheet. Therefore, in the present Example, the dislocation density in the metal phases at the widthwise central portion of the sheet was measured and used for evaluation.

3. Evaluation Results

The results of the evaluation are shown in Table 2.

TABLE 2

| | Microstructure | | | | Tensile properties | | Delayed fracture resistance | Shape | |
|---|---|---|---|---|---|---|---|---|---|
| No. | M % | F % | Others % | *1 % | YS MPa | TS MPa | Critical load stress MPa | Maximum warpage mm | Remarks |
| 1 | 97 | 2 | 1 | 58 | 1257 | 1522 | 1510 | 1 | Inventive Example |
| 2 | 96 | 2 | 2 | 4 | 1248 | 1570 | 510 | 22 | Comparative Example |

TABLE 2-continued

| No. | Microstructure M % | F % | Others % | *1 % | Tensile properties YS MPa | TS MPa | Delayed fracture resistance Critical load stress MPa | Shape Maximum warpage mm | Remarks |
|---|---|---|---|---|---|---|---|---|---|
| 3 | 97 | 2 | 1 | 38 | 1267 | 1532 | 1382 | 7 | Inventive Example |
| 4 | 97 | 1 | 2 | 17 | 1288 | 1579 | 1168 | 5 | Comparative Example |
| 5 | 98 | 1 | 1 | 28 | 1299 | 1529 | 1252 | 11 | Comparative Example |
| 6 | 97 | 1 | 2 | 45 | 1354 | 1532 | 1423 | 4 | Inventive Example |
| 7 | 99 | 1 | 0 | 21 | 1272 | 1546 | 1101 | 7 | Comparative Example |
| 8 | 98 | 1 | 1 | 82 | 1400 | 1627 | 1264 | 4 | Comparative Example |

M: Area fraction of martensite,

F: Area fraction of ferrite,

Others: Area fraction of other metal phases

*1: The ratio of the dislocation density in the metal phases on the surface of the steel sheet to the dislocation density in the metal phases in the thicknesswise central portion of the sheet (the dislocation density in the metal phases on the surface of the steel sheet/the dislocation density in the metal phases in the thicknesswise central portion of the sheet).

In the present Example, a steel sheet was rated pass when the TS was 750 MPa or more, the critical load stress was equal to or larger than the YS, and the maximum amount of warpage was 15 mm or less and shown as Inventive Example in Table 2. However, a steel sheet was rated fail when at least one of the above conditions was not satisfied and shown as Comparative Example in Table 2.

Example 2

1. Production of Steel Sheets for Evaluation

Steel having a chemical composition shown in Table 3 with the balance being Fe and incidental impurities was obtained by steel making using a vacuum melting furnace and cogged to obtain a cogged product having a thickness of 27 mm. The cogged product obtained was hot-rolled. Then samples to be cold-rolled were obtained by grinding the hot-rolled steel sheet. These samples were cold-rolled at a rolling reduction shown in Table 4 or 5 to thereby produce cold-rolled steel sheets having a thickness shown in Table 4 or 5. Some samples obtained by grinding the hot-rolled steel sheet were not subjected to cold rolling. In the tables, a sample with "-" in the rolling reduction column was not subjected to cold rolling. Next, the above-obtained hot-rolled steel sheets and the cold-rolled steel sheets were annealed under conditions shown in Tables 4 or 5 to thereby produce steel sheets. Each blank in Table 3 means that a corresponding element was not added intentionally. This means not only that the element was not added (0% by mass) but also that the element was inevitably contained. The temperature of the steel sheet when it passed between the restraining rolls was measured using a contact-type thermometer attached to one of the rolls. The two rolls were disposed such that the depression amounts of the two rolls were the same.

In the hot rolling before the cold rolling, the slab heating temperature of the steel slab was set to 1250° C., and the slab soaking time during slab heating was set to 60 minutes. The finish rolling temperature was set to 880° C., and the coiling temperature was set to 550° C.

TABLE 3

| Steel type | Chemical composition (% by mass) C | Si | Mn | P | S | Al | N | B | Nb | Ti | Cu | Ni | Cr | Mo | V | Sb | Sn | $A_{c1}$ temperature (° C.) |
|---|---|---|---|---|---|---|---|---|---|---|---|---|---|---|---|---|---|---|
| A | 0.06 | 1.00 | 2.20 | 0.007 | 0.0008 | 0.051 | 0.0021 | | | | | | | | | | | 705 |
| B | 0.11 | 0.90 | 0.20 | 0.008 | 0.0003 | 0.068 | 0.0048 | | | | | | | | | | | 739 |
| C | 0.14 | 1.40 | 2.40 | 0.008 | 0.0005 | 0.080 | 0.0021 | | | | | | | | | | | 711 |
| D | 0.22 | 0.40 | 1.50 | 0.018 | 0.0002 | 0.021 | 0.0043 | | | | | | | | | | | 705 |
| E | 0.26 | 0.20 | 1.00 | 0.010 | 0.0010 | 0.008 | 0.0043 | | | | | | | | | | | 709 |
| F | 0.28 | 1.40 | 1.50 | 0.010 | 0.0010 | 0.049 | 0.0058 | | | | | | | | | | | 727 |
| G | 0.22 | 1.50 | 2.80 | 0.007 | 0.0040 | 0.036 | 0.0014 | | | | | | | | | | | 706 |
| H | 0.42 | 1.40 | 0.80 | 0.007 | 0.0010 | 0.078 | 0.0034 | | | | | | | | | | | 739 |
| I | 0.54 | 0.12 | 0.25 | 0.006 | 0.0007 | 0.096 | 0.0046 | | | | | | | | | | | 721 |
| J | 0.28 | 1.60 | 1.40 | 0.025 | 0.0002 | 0.092 | 0.0028 | | | | | | | | | | | 733 |
| K | 0.27 | 1.80 | 1.60 | 0.009 | 0.0009 | 0.026 | 0.0031 | | | | | | | | | | | 734 |
| L | 0.15 | 0.01 | 2.90 | 0.016 | 0.0004 | 0.039 | 0.0028 | | | | | | | | | | | 671 |
| M | 0.14 | 0.07 | 3.10 | 0.005 | 0.0004 | 0.050 | 0.0015 | | | | | | | | | | | 669 |
| N | 0.26 | 0.90 | 1.50 | 0.006 | 0.0010 | 0.066 | 0.0053 | | | | | | 0.05 | | | | | 717 |
| O | 0.24 | 0.80 | 1.70 | 0.038 | 0.0006 | 0.051 | 0.0040 | | 0.0100 | | | | | 0.04 | | | | 710 |
| P | 0.28 | 0.40 | 0.90 | 0.006 | 0.0020 | 0.062 | 0.0027 | | | | | | 0.04 | 0.08 | 0.005 | | | 717 |
| Q | 0.32 | 0.05 | 0.60 | 0.009 | 0.0002 | 0.063 | 0.0088 | | 0.0060 | 0.004 | | | | | | | | 713 |

TABLE 3-continued

| Steel type | Chemical composition (% by mass) C | Si | Mn | P | S | Al | N | B | Nb | Ti | Cu | Ni | Cr | Mo | V | Sb | Sn | $A_{c1}$ temperature (° C.) |
|---|---|---|---|---|---|---|---|---|---|---|---|---|---|---|---|---|---|---|
| R | 0.15 | 1.20 | 2.40 | 0.007 | 0.0004 | 0.038 | 0.0051 | | | | 0.005 | 0.004 | | | | | | 706 |
| S | 0.18 | 1.40 | 2.30 | 0.006 | 0.0003 | 0.040 | 0.0037 | 0.0007 | | | | | | | | | | 712 |
| T | 0.24 | 1.30 | 2.10 | 0.017 | 0.0005 | 0.034 | 0.0019 | | | | | | | | | 0.008 | 0.005 | 714 |
| U | 0.63 | 1.10 | 1.20 | 0.019 | 0.0002 | 0.035 | 0.0021 | | | | | | | | | | | 726 |
| V | 0.04 | 1.20 | 1.20 | 0.006 | 0.0002 | 0.077 | 0.0055 | | | | | | | | | | | 728 |
| W | 0.21 | 2.40 | 1.05 | 0.008 | 0.0010 | 0.023 | 0.0028 | | | | | | | | | | | 757 |
| X | 0.22 | 0.12 | 3.40 | 0.026 | 0.0006 | 0.069 | 0.0024 | | | | | | | | | | | 664 |
| Y | 0.22 | 0.16 | 0.04 | 0.008 | 0.0007 | 0.059 | 0.0010 | | | | | | | | | | | 726 |
| Z | 0.28 | 0.84 | 1.20 | 0.070 | 0.0004 | 0.069 | 0.0058 | | | | | | | | | | | 720 |
| AA | 0.26 | 0.07 | 1.32 | 0.007 | 0.0080 | 0.059 | 0.0028 | | | | | | | | | | | 701 |
| AB | 0.25 | 0.11 | 1.31 | 0.006 | 0.0003 | 0.150 | 0.0021 | | | | | | | | | | | 702 |
| AC | 0.21 | 0.05 | 1.28 | 0.018 | 0.0008 | 0.071 | 0.0150 | | | | | | | | | | | 701 |
| AD | 0.20 | 0.40 | 1.40 | 0.012 | 0.0007 | 0.035 | 0.0040 | | 0.0080 | | 0.080 | | | | | | | 707 |
| AE | 0.20 | 0.20 | 1.60 | 0.012 | 0.0009 | 0.045 | 0.0050 | | | | 0.050 | | 0.08 | 0.05 | | | | 700 |
| AF | 0.21 | 0.40 | 1.40 | 0.010 | 0.0007 | 0.045 | 0.0050 | | 0.0100 | | 0.060 | | | 0.12 | | | | 707 |
| AG | 0.20 | 0.60 | 1.20 | 0.012 | 0.0007 | 0.030 | 0.0040 | 0.0012 | | | 0.080 | | 0.12 | | | | | 717 |
| AH | 0.20 | 0.40 | 1.40 | 0.012 | 0.0005 | 0.045 | 0.0050 | 0.0016 | | 0.015 | | | | | | | | 707 |
| AI | 0.19 | 0.50 | 1.80 | 0.014 | 0.0007 | 0.045 | 0.0050 | | | | | | 0.05 | | | | 0.008 | 702 |
| AJ | 0.20 | 0.30 | 1.40 | 0.012 | 0.0007 | 0.040 | 0.0050 | 0.0010 | | 0.012 | | | | | | | 0.020 | 704 |
| AK | 0.20 | 0.40 | 1.50 | 0.012 | 0.0007 | 0.045 | 0.0050 | 0.0015 | | | 0.120 | | 0.06 | | | | 0.012 | 706 |

TABLE 4

| No. | Steel type | Sheet thickness mm | Cold rolling Rolling reduction % | Annealing conditions: Annealing temperature ° C. | Annealing holding time Seconds | Quenching start temperature ° C. | *1 ° C. | *2 mm | *3 mm | Roll diameter Rn mm | Roll diameter rn mm | Water cooling stop temperature ° C. | Reheating temperature ° C. | Remarks |
|---|---|---|---|---|---|---|---|---|---|---|---|---|---|---|
| 1 | A | 1.4 | 56 | 760 | 60 | 831 | 300 | 2.5 | 100 | 300 | 300 | 50 | 150 | Inventive Example |
| 2 | | 1.4 | 56 | 760 | 60 | 801 | 300 | 2.5 | 200 | 300 | 300 | 50 | 150 | Inventive Example |
| 3 | | 1.4 | 56 | 760 | 60 | 709 | — | — | — | — | — | 50 | 150 | Comparative Example |
| 4 | | 1.4 | 56 | 760 | 60 | 845 | 300 | 2.5 | 600 | 300 | 300 | 50 | 150 | Comparative Example |
| 5 | B | 1.4 | 56 | 800 | 60 | 717 | 300 | 2.5 | 100 | 300 | 300 | 50 | 150 | Inventive Example |
| 6 | | 1.4 | 56 | 800 | 60 | 900 | 300 | 2.2 | 100 | 300 | 300 | 50 | 150 | Inventive Example |
| 7 | | 1.4 | 56 | 800 | 60 | 887 | 300 | 2.8 | 100 | 300 | 300 | 50 | 150 | Inventive Example |
| 8 | | 1.4 | 56 | 800 | 60 | 761 | 300 | 3.0 | 100 | 300 | 300 | 50 | 150 | Inventive Example |
| 9 | C | 1.4 | 56 | 820 | 60 | 830 | 300 | 2.5 | 100 | 40 | 300 | 50 | 150 | Comparative Example |
| 10 | | 1.4 | 56 | 820 | 60 | 858 | 300 | 2.5 | 100 | 70 | 200 | 50 | 150 | Inventive Example |
| 11 | | 1.4 | 56 | 820 | 60 | 894 | 300 | 2.5 | 100 | 400 | 300 | 50 | 150 | Inventive Example |
| 12 | | 1.4 | 56 | 820 | 60 | 767 | 300 | 2.5 | 100 | 300 | 500 | 50 | 150 | Inventive Example |
| 13 | D | 1.4 | 56 | 872 | 60 | 827 | 300 | 2.5 | 100 | 300 | 300 | 50 | 150 | Inventive Example |
| 14 | | 1.4 | 56 | 880 | 60 | 819 | 300 | 2.5 | 40 | 300 | 300 | 50 | 150 | Inventive Example |
| 15 | | 1.4 | 56 | 884 | 60 | 779 | 300 | 2.5 | 300 | 300 | 300 | 50 | 150 | Inventive Example |
| 16 | | 1.4 | 56 | 898 | 60 | 803 | 300 | 2.5 | 550 | 300 | 300 | 50 | 150 | Comparative Example |
| 17 | E | 1.4 | 56 | 867 | 60 | 731 | 300 | 2.5 | 100 | 300 | 300 | 50 | 150 | Inventive Example |
| 18 | | 1.4 | 56 | 883 | 60 | 860 | 300 | 1.1 | 100 | 300 | 300 | 50 | 150 | Comparative Example |
| 19 | | 1.4 | 56 | 899 | 60 | 714 | 300 | 3.2 | 100 | 300 | 300 | 50 | 150 | Inventive Example |

TABLE 4-continued

| No. | Steel type | Sheet thickness mm | Cold rolling Rolling reduction % | Annealing conditions: Annealing temperature ° C. | Annealing holding time Seconds | Quenching start temperature ° C. | *1 ° C. | *2 mm | *3 mm | Roll diameter Rn mm | Roll diameter rn mm | Water cooling stop temperature ° C. | Reheating temperature ° C. | Remarks |
|---|---|---|---|---|---|---|---|---|---|---|---|---|---|---|
| 20 | | 1.4 | 56 | 888 | 60 | 738 | 300 | 3.6 | 100 | 300 | 300 | 50 | 150 | Comparative Example |
| 21 | F | 1.4 | 56 | 894 | 60 | 806 | 550 | 2.5 | 100 | 150 | 150 | 50 | 150 | Comparative Example |
| 22 | | 1.4 | 56 | 882 | 60 | 835 | 400 | 2.5 | 100 | 150 | 150 | 50 | 150 | Inventive Example |
| 23 | | 1.4 | 56 | 882 | 60 | 835 | 300 | 2.5 | 100 | 150 | 150 | 50 | 150 | Inventive Example |
| 24 | | 1.4 | 56 | 890 | 60 | 830 | 150 | 2.5 | 100 | 150 | 150 | 50 | 150 | Inventive Example |
| 25 | G | 1.4 | 56 | 895 | 60 | 807 | 520 | 2.5 | 100 | 150 | 150 | 50 | 150 | Comparative Example |
| 26 | | 1.4 | 56 | 885 | 60 | 763 | 410 | 2.5 | 100 | 150 | 150 | 50 | 150 | Inventive Example |
| 27 | | 1.4 | 56 | 885 | 60 | 763 | 150 | 2.5 | 100 | 150 | 150 | 50 | 150 | Inventive Example |
| 28 | | 1.4 | 56 | 882 | 60 | 758 | 50 | 2.5 | 100 | 150 | 150 | 50 | 150 | Inventive Example |
| 29 | H | 3.2 | — | 815 | 60 | 733 | 300 | 3.5 | 100 | 150 | 150 | 50 | 150 | Inventive Example |
| 30 | | 1.9 | 40 | 850 | 60 | 772 | 300 | 2.5 | 100 | 150 | 150 | 50 | 150 | Inventive Example |
| 31 | | 0.6 | 80 | 870 | 60 | 829 | 300 | 1.0 | 100 | 150 | 150 | 50 | 150 | Inventive Example |
| 32 | I | 1.4 | 56 | 770 | 60 | 741 | 200 | 2.5 | 100 | 150 | 150 | 50 | 150 | Inventive Example |
| 33 | J | 1.4 | 56 | 890 | 60 | 730 | 300 | 2.5 | 100 | 150 | 150 | 50 | 150 | Inventive Example |
| 34 | | 1.4 | 56 | 880 | 20 | 799 | 300 | 2.5 | 100 | 150 | 150 | 50 | 150 | Comparative Example |
| 35 | | 1.4 | 56 | 889 | 360 | 767 | 300 | 2.5 | 100 | 150 | 150 | 50 | 150 | Inventive Example |
| 36 | K | 1.4 | 56 | 879 | 40 | 755 | 300 | 2.5 | 100 | 150 | 150 | 50 | 150 | Inventive Example |
| 37 | | 1.4 | 56 | 886 | 60 | 550 | 300 | 2.5 | 100 | 150 | 150 | 50 | 150 | Inventive Example |
| 38 | | 1.4 | 56 | 870 | 60 | 350 | 300 | 2.5 | 100 | 150 | 150 | 50 | 150 | Comparative Example |
| 39 | L | 1.4 | 56 | 863 | 60 | 650 | 300 | 2.5 | 100 | 150 | 150 | 50 | 150 | Inventive Example |
| 40 | | 1.4 | 56 | 861 | 60 | 340 | 300 | 2.5 | 100 | 150 | 150 | 50 | 150 | Comparative Example |
| 41 | | 1.4 | 56 | 873 | 60 | 450 | 300 | 2.5 | 100 | 150 | 150 | 50 | 150 | Inventive Example |
| 42 | M | 1.4 | 56 | 891 | 60 | 702 | 300 | 2.5 | 100 | 150 | 150 | 80 | 150 | Inventive Example |
| 43 | | 1.4 | 56 | 875 | 60 | 727 | 300 | 2.5 | 100 | 150 | 150 | 50 | 150 | Inventive Example |
| 44 | | 1.4 | 56 | 878 | 60 | 635 | 300 | 2.5 | 100 | 150 | 150 | 150 | 150 | Comparative Example |

*1: The surface temperature of the steel sheet when it was restrained by the rolls.

*2: The depression amount of each of the two rolls.

*3: The inter-roll distance between the two rolls.

TABLE 5

| No. | Steel type | Sheet thickness mm | Cold rolling Rolling reduction % | Annealing conditions: Annealing temperature ° C. | Annealing holding time Seconds | Quenching start temperature ° C. | *1 ° C. | *2 mm | *3 mm | Roll diameter Rn mm | Roll diameter rn mm | Water cooling stop temperature ° C. | Reheating temperature ° C. | Remarks |
|---|---|---|---|---|---|---|---|---|---|---|---|---|---|---|
| 45 | N | 1.4 | 56 | 876 | 60 | 757 | 300 | 2.5 | 100 | 300 | 300 | 50 | 150 | Inventive Example |
| 46 | | 1.4 | 56 | 895 | 60 | 824 | — | — | — | — | — | 50 | 200 | Comparative Example |
| 47 | | 1.4 | 56 | 895 | 60 | 824 | 300 | 2.5 | 100 | 300 | 300 | 50 | 250 | Inventive Example |
| 48 | | 1.4 | 56 | 884 | 60 | 754 | 300 | 2.5 | 100 | 300 | 300 | 50 | 320 | Comparative Example |
| 49 | O | 1.4 | 56 | 881 | 60 | 694 | 300 | 2.5 | 100 | 150 | 150 | 50 | 80 | Comparative Example |
| 50 | | 1.4 | 56 | 877 | 60 | 877 | 300 | 2.5 | 100 | 150 | 150 | 50 | 180 | Inventive Example |
| 51 | | 1.4 | 56 | 877 | 60 | 877 | 300 | 2.5 | 100 | 150 | 150 | 50 | 320 | Comparative Example |
| 52 | | 1.4 | 56 | 876 | 60 | 793 | 300 | 2.5 | 100 | 150 | 150 | 50 | 120 | Inventive Example |
| 53 | P | 1.4 | 56 | 863 | 20 | 753 | 300 | 2.5 | 100 | 150 | 150 | 50 | 150 | Comparative Example |
| 54 | | 1.4 | 56 | 877 | 32 | 848 | 300 | 2.5 | 100 | 150 | 150 | 50 | 150 | Inventive Example |
| 55 | | 1.4 | 56 | 877 | 240 | 848 | 300 | 2.5 | 100 | 150 | 150 | 50 | 150 | Inventive Example |
| 56 | | 1.4 | 56 | 871 | 600 | 766 | 300 | 2.5 | 100 | 150 | 150 | 50 | 150 | Inventive Example |
| 57 | Q | 1.4 | 56 | 872 | 60 | 845 | 300 | 2.5 | 0 | 150 | 150 | 50 | 150 | Comparative Example |
| 58 | | 1.4 | 56 | 871 | 60 | 788 | 300 | 2.5 | 15 | 150 | 150 | 50 | 150 | Comparative Example |
| 59 | | 1.4 | 56 | 871 | 60 | 788 | 300 | 2.5 | 30 | 150 | 150 | 50 | 150 | Inventive Example |
| 60 | | 1.4 | 56 | 892 | 60 | 783 | 300 | 2.5 | 100 | 150 | 150 | 50 | 150 | Inventive Example |
| 61 | R | 1.4 | 56 | 890 | 60 | 882 | 300 | 1.0 | 100 | 150 | 150 | 50 | 150 | Comparative Example |
| 62 | | 1.4 | 56 | 881 | 60 | 875 | 300 | 2.4 | 100 | 150 | 150 | 50 | 150 | Inventive Example |
| 63 | | 1.4 | 56 | 881 | 60 | 875 | 300 | 3.1 | 100 | 150 | 150 | 50 | 150 | Inventive Example |
| 64 | | 1.4 | 56 | 860 | 60 | 684 | 300 | 3.6 | 100 | 150 | 150 | 50 | 150 | Comparative Example |
| 65 | S | 1.4 | 56 | 877 | 60 | 705 | 300 | 2.5 | 100 | 60 | 300 | 50 | 150 | Inventive Example |
| 66 | | 1.4 | 56 | 898 | 60 | 755 | 300 | 2.5 | 100 | 200 | 40 | 50 | 150 | Comparative Example |
| 67 | | 1.4 | 56 | 898 | 60 | 755 | 300 | 2.5 | 100 | 800 | 400 | 50 | 150 | Inventive Example |
| 68 | | 1.4 | 56 | 894 | 60 | 702 | 300 | 2.5 | 100 | 1200 | 500 | 50 | 150 | Comparative Example |
| 69 | T | 1.4 | 56 | 898 | 60 | 880 | 500 | 2.5 | 100 | 300 | 300 | 50 | 150 | Inventive Example |
| 70 | | 1.4 | 56 | 869 | 60 | 743 | 350 | 2.5 | 100 | 300 | 300 | 50 | 150 | Inventive Example |
| 71 | | 1.4 | 56 | 869 | 60 | 743 | 50 | 2.5 | 100 | 300 | 300 | 50 | 150 | Inventive Example |
| 72 | | 1.4 | 56 | 899 | 60 | 686 | 560 | 2.5 | 100 | 300 | 300 | 50 | 150 | Comparative Example |
| 73 | U | 1.4 | 56 | 898 | 60 | 896 | 300 | 2.5 | 100 | 300 | 300 | 50 | 150 | Comparative Example |
| 74 | V | 1.4 | 56 | 886 | 60 | 700 | 300 | 2.5 | 100 | 300 | 300 | 50 | 150 | Comparative Example |
| 75 | W | 1.4 | 56 | 890 | 60 | 838 | 300 | 2.5 | 100 | 300 | 300 | 50 | 150 | Comparative Example |
| 76 | X | 1.4 | 56 | 893 | 60 | 740 | 300 | 2.5 | 100 | 300 | 300 | 50 | 150 | Comparative Example |
| 77 | Y | 1.4 | 56 | 895 | 60 | 804 | 200 | 2.5 | 100 | 300 | 300 | 50 | 150 | Comparative Example |
| 78 | Z | 1.4 | 56 | 898 | 60 | 831 | 300 | 2.5 | 100 | 300 | 300 | 50 | 150 | Comparative Example |
| 79 | AA | 1.4 | 56 | 890 | 60 | 807 | 300 | 2.5 | 100 | 300 | 300 | 50 | 150 | Comparative Example |

TABLE 5-continued

| No. | Steel type | Sheet thick-ness mm | Cold rolling Rolling reduc-tion % | Annealing conditions: Annealing temper-ature ° C. | Annealing holding time Seconds | Quenching start temper-ature ° C. | *1 ° C. | *2 mm | *3 mm | Roll diameter Rn mm | Roll diameter rn mm | Water cooling stop temper-ature ° C. | Reheating temper-ature ° C. | Remarks |
|---|---|---|---|---|---|---|---|---|---|---|---|---|---|---|
| 80 | AB | 1.4 | 56 | 890 | 60 | 807 | 300 | 2.5 | 100 | 300 | 300 | 50 | 150 | Comparative Example |
| 81 | AC | 1.4 | 56 | 873 | 60 | 829 | 300 | 2.5 | 100 | 300 | 300 | 50 | 150 | Comparative Example |
| 82 | AD | 1.4 | 56 | 880 | 60 | 760 | 210 | 1.8 | 30 | 150 | 150 | 50 | 170 | Inventive Example |
| 83 | AE | 1.4 | 56 | 880 | 60 | 650 | 340 | 1.8 | 30 | 150 | 150 | 50 | 170 | Inventive Example |
| 84 | AF | 1.4 | 56 | 880 | 60 | 730 | 260 | 1.8 | 80 | 150 | 150 | 50 | 170 | Inventive Example |
| 85 | AG | 1.4 | 56 | 880 | 60 | 760 | 250 | 1.8 | 80 | 150 | 150 | 50 | 170 | Inventive Example |
| 86 | AH | 1.4 | 56 | 880 | 60 | 730 | 200 | 2.2 | 40 | 150 | 150 | 50 | 170 | Inventive Example |
| 87 | AI | 1.4 | 56 | 880 | 60 | 730 | 260 | 2.2 | 40 | 150 | 150 | 50 | 170 | Inventive Example |
| 88 | AJ | 1.4 | 56 | 880 | 60 | 730 | 160 | 2.6 | 60 | 150 | 150 | 50 | 170 | Inventive Example |
| 89 | AK | 1.4 | 56 | 880 | 60 | 730 | 230 | 2.6 | 60 | 150 | 150 | 50 | 170 | Inventive Example |

*1: The surface temperature of the steel sheet when it was restrained by the rolls.
*2: The depression amount of each of the two rolls.
*3: The inter-roll distance between the two rolls.

2. Evaluation Methods

For each of the steel sheets obtained under various production conditions, the steel microstructure was analyzed to examine microstructure fractions, and a tensile test was performed to evaluate tensile properties such as tensile strength. Moreover, the delayed fracture test was performed to evaluate the delayed fracture resistance, and the warpage of the steel sheet was used to evaluate the shape uniformity. X-ray diffraction measurement was performed to examine the dislocation density in the metal phases. The evaluation methods are the same as those in Example 1.

3. Evaluation Results

The results of the evaluation are shown in Tables 6 and 7.

TABLE 6

| No. | Steel type | Microstructure: M % | F % | Others % | Transformation temperature: Ms ° C. | *1 % | Tensile properties: YS MPa | TS MPa | Delayed fracture resistance Critical load stress MPa | Shape Maximum warpage mm | Remarks |
|---|---|---|---|---|---|---|---|---|---|---|---|
| 1 | A | 32 | 65 | 3 | 396 | 55 | 647 | 775 | 872 | 6 | Inventive Example |
| 2 | | 32 | 64 | 4 | 396 | 46 | 656 | 782 | 936 | 3 | Inventive Example |
| 3 | | 35 | 65 | 0 | 402 | 4 | 648 | 780 | 510 | 22 | Comparative Example |
| 4 | | 38 | 61 | 1 | 407 | 16 | 638 | 779 | 622 | 6 | Comparative Example |
| 5 | B | 43 | 55 | 2 | 452 | 52 | 825 | 982 | 1098 | 4 | Inventive Example |
| 6 | | 46 | 50 | 4 | 458 | 58 | 819 | 988 | 1078 | 9 | Inventive Example |
| 7 | | 46 | 49 | 5 | 458 | 63 | 843 | 986 | 1035 | 6 | Inventive Example |
| 8 | | 41 | 54 | 5 | 448 | 72 | 809 | 978 | 952 | 3 | Inventive Example |
| 9 | C | 54 | 41 | 5 | 363 | 53 | 997 | 1216 | 1270 | 16 | Comparative Example |
| 10 | | 61 | 37 | 2 | 374 | 64 | 1026 | 1221 | 1260 | 6 | Inventive Example |
| 11 | | 57 | 42 | 1 | 368 | 56 | 974 | 1222 | 1222 | 7 | Inventive Example |
| 12 | | 54 | 43 | 3 | 363 | 54 | 1023 | 1217 | 1290 | 2 | Inventive Example |

TABLE 6-continued

| No. | Steel type | Microstructure M % | Microstructure F % | Microstructure Others % | Transformation temperature Ms ° C. | *1 % | Tensile properties YS MPa | Tensile properties TS MPa | Delayed fracture resistance Critical load stress MPa | Shape Maximum warpage mm | Remarks |
|---|---|---|---|---|---|---|---|---|---|---|---|
| 13 | D | 85 | 15 | 0 | 399 | 55 | 1165 | 1433 | 1346 | 5 | Inventive Example |
| 14 | | 88 | 7 | 5 | 403 | 33 | 1187 | 1443 | 1224 | 3 | Inventive Example |
| 15 | | 93 | 6 | 1 | 407 | 35 | 1235 | 1446 | 1287 | 1 | Inventive Example |
| 16 | | 84 | 12 | 4 | 398 | 21 | 1172 | 1446 | 1101 | 6 | Comparative Example |
| 17 | E | 99 | 0 | 1 | 418 | 50 | 1276 | 1535 | 1515 | 3 | Inventive Example |
| 18 | | 96 | 4 | 0 | 415 | 28 | 1299 | 1529 | 1252 | 11 | Comparative Example |
| 19 | | 90 | 8 | 2 | 409 | 78 | 1067 | 1260 | 1075 | 7 | Inventive Example |
| 20 | | 98 | 0 | 2 | 417 | 83 | 1030 | 1240 | 982 | 3 | Comparative Example |
| 21 | F | 91 | 4 | 5 | 382 | 53 | 1409 | 1736 | 1650 | 16 | Comparative Example |
| 22 | | 95 | 5 | 0 | 387 | 51 | 1461 | 1748 | 1709 | 4 | Inventive Example |
| 23 | | 89 | 7 | 4 | 380 | 63 | 1439 | 1740 | 1640 | 7 | Inventive Example |
| 24 | | 100 | 0 | 0 | 392 | 62 | 1403 | 1751 | 1600 | 2 | Inventive Example |
| 25 | G | 96 | 1 | 3 | 358 | 58 | 1391 | 1705 | 1580 | 19 | Comparative Example |
| 26 | | 94 | 1 | 5 | 356 | 57 | 1405 | 1696 | 1550 | 6 | Inventive Example |
| 27 | | 100 | 0 | 0 | 361 | 64 | 1435 | 1709 | 1687 | 6 | Inventive Example |
| 28 | | 91 | 4 | 5 | 353 | 64 | 1426 | 1699 | 1600 | 4 | Inventive Example |
| 29 | H | 99 | 1 | 0 | 370 | 62 | 1895 | 2286 | 2141 | 10 | Inventive Example |
| 30 | | 97 | 0 | 3 | 366 | 64 | 1838 | 2280 | 2051 | 9 | Inventive Example |
| 31 | | 94 | 1 | 5 | 362 | 62 | 1909 | 2268 | 2130 | 10 | Inventive Example |
| 32 | I | 48 | 50 | 2 | 146 | 64 | 1212 | 1500 | 1420 | 9 | Inventive Example |
| 33 | J | 96 | 3 | 1 | 392 | 73 | 1412 | 1727 | 1560 | 6 | Inventive Example |
| 34 | | 97 | 1 | 2 | 393 | 84 | 1416 | 1719 | 1280 | 7 | Comparative Example |
| 35 | | 94 | 4 | 2 | 390 | 72 | 1440 | 1724 | 1610 | 3 | Inventive Example |
| 36 | K | 99 | 1 | 0 | 391 | 76 | 1369 | 1719 | 1417 | 4 | Inventive Example |
| 37 | | 94 | 6 | 0 | 385 | 74 | 1418 | 1706 | 1566 | 6 | Inventive Example |
| 38 | | 96 | 4 | 0 | 388 | 72 | 1454 | 1706 | 1616 | 19 | Comparative Example |
| 39 | L | 94 | 6 | 0 | 378 | 73 | 1123 | 1378 | 1308 | 8 | Inventive Example |
| 40 | | 91 | 8 | 1 | 376 | 72 | 1120 | 1369 | 1250 | 18 | Comparative Example |
| 41 | | 93 | 2 | 5 | 378 | 71 | 1120 | 1364 | 1279 | 13 | Inventive Example |
| 42 | M | 83 | 15 | 2 | 367 | 71 | 1156 | 1359 | 1269 | 10 | Inventive Example |
| 43 | | 90 | 9 | 1 | 372 | 74 | 1130 | 1366 | 1307 | 3 | Inventive Example |
| 44 | | 92 | 4 | 4 | 373 | 70 | 1159 | 1364 | 1301 | 17 | Comparative Example |

M: Area fraction of martensite,

F: Area fraction of ferrite,

Others: Area fraction of other metal phases

*1: The ratio of the dislocation density in the metal phases on the surface of the steel sheet to the dislocation density in the metal phases in the thicknesswise central portion of the sheet (the dislocation density in the metal phases on the surface of the steel sheet/the dislocation density in the metal phases in the thicknesswise central portion of the sheet).

TABLE 7

| No. | Steel type | Microstructure M % | Microstructure F % | Microstructure Others % | Transformation temperature Ms ° C. | *1 % | Tensile properties YS MPa | Tensile properties TS MPa | Delayed fracture resistance Critical load stress MPa | Shape Maximum warpage mm | Remarks |
|---|---|---|---|---|---|---|---|---|---|---|---|
| 45 | N | 93 | 4 | 3 | 391 | 57 | 1356 | 1631 | 1611 | 6 | Inventive Example |
| 46 | | 92 | 3 | 5 | 390 | 9 | 1367 | 1642 | 1237 | 26 | Comparative Example |
| 47 | | 98 | 0 | 2 | 396 | 57 | 1387 | 1644 | 1567 | 10 | Inventive Example |
| 48 | | 95 | 2 | 3 | 393 | 64 | 1397 | 1648 | 1676 | 18 | Comparative Example |
| 49 | O | 97 | 2 | 1 | 395 | 82 | 1300 | 1577 | 1264 | 3 | Comparative Example |
| 50 | | 96 | 0 | 4 | 394 | 73 | 1274 | 1570 | 1440 | 1 | Inventive Example |
| 51 | | 99 | 1 | 0 | 396 | 74 | 1338 | 1571 | 1456 | 19 | Comparative Example |
| 52 | | 97 | 0 | 3 | 395 | 78 | 1261 | 1578 | 1340 | 0 | Inventive Example |
| 53 | P | 94 | 4 | 2 | 407 | 88 | 1364 | 1619 | 1299 | 6 | Comparative Example |
| 54 | | 97 | 0 | 3 | 411 | 79 | 1310 | 1626 | 1364 | 5 | Inventive Example |
| 55 | | 96 | 0 | 4 | 410 | 63 | 1379 | 1625 | 1658 | 3 | Inventive Example |
| 56 | | 96 | 3 | 1 | 410 | 66 | 1300 | 1627 | 1546 | 7 | Inventive Example |
| 57 | Q | 97 | 3 | 0 | 411 | 12 | 1348 | 1665 | 1310 | 7 | Comparative Example |
| 58 | | 97 | 0 | 3 | 411 | 17 | 1388 | 1679 | 1382 | 5 | Comparative Example |
| 59 | | 100 | 0 | 0 | 414 | 35 | 1422 | 1673 | 1497 | 5 | Inventive Example |
| 60 | | 97 | 3 | 0 | 411 | 59 | 1353 | 1676 | 1611 | 5 | Inventive Example |
| 61 | R | 90 | 10 | 0 | 396 | 15 | 1079 | 1269 | 1051 | 4 | Comparative Example |
| 62 | | 84 | 14 | 2 | 391 | 59 | 1069 | 1271 | 1281 | 3 | Inventive Example |
| 63 | | 90 | 7 | 3 | 396 | 75 | 1081 | 1272 | 1103 | 6 | Inventive Example |
| 64 | | 89 | 8 | 3 | 395 | 85 | 1062 | 1265 | 1036 | 4 | Comparative Example |
| 65 | S | 99 | 1 | 0 | 394 | 52 | 1172 | 1416 | 1386 | 3 | Inventive Example |
| 66 | | 89 | 11 | 0 | 387 | 54 | 1117 | 1404 | 1332 | 16 | Comparative Example |
| 67 | | 91 | 8 | 1 | 389 | 70 | 1191 | 1407 | 1395 | 5 | Inventive Example |
| 68 | | 94 | 4 | 2 | 391 | 70 | 1137 | 1400 | 1305 | 17 | Comparative Example |
| 69 | T | 95 | 1 | 4 | 378 | 65 | 1367 | 1663 | 1591 | 15 | Inventive Example |
| 70 | | 94 | 6 | 0 | 377 | 58 | 1396 | 1666 | 1646 | 5 | Inventive Example |
| 71 | | 95 | 0 | 5 | 378 | 57 | 1389 | 1653 | 1607 | 4 | Inventive Example |
| 72 | | 94 | 4 | 2 | 377 | 51 | 1331 | 1660 | 1576 | 17 | Comparative Example |
| 73 | U | 97 | 0 | 3 | 275 | 63 | 2787 | 3323 | 3263 | 18 | Comparative Example |
| 74 | V | 12 | 88 | 0 | 385 | 57 | 407 | 471 | 480 | 2 | Comparative Example |
| 75 | W | 92 | 8 | 0 | 428 | 85 | 1036 | 1280 | 961 | 3 | Comparative Example |
| 76 | X | 94 | 3 | 3 | 332 | 82 | 1456 | 1812 | 1384 | 2 | Comparative Example |
| 77 | Y | 17 | 83 | 0 | 95 | 66 | 603 | 711 | 658 | 4 | Comparative Example |
| 78 | Z | 92 | 6 | 2 | 395 | 90 | 1383 | 1680 | 1343 | 3 | Comparative Example |
| 79 | AA | 96 | 0 | 4 | 402 | 81 | 1313 | 1603 | 1234 | 5 | Comparative Example |

TABLE 7-continued

| No. | Steel type | Microstructure M % | F % | Others % | Transformation temperature Ms ° C. | *1 % | Tensile properties YS MPa | TS MPa | Delayed fracture resistance Critical load stress MPa | Shape Maximum warpage mm | Remarks |
|---|---|---|---|---|---|---|---|---|---|---|---|
| 80 | AB | 99 | 1 | 0 | 409 | 81 | 1293 | 1556 | 1194 | 4 | Comparative Example |
| 81 | AC | 90 | 5 | 5 | 417 | 84 | 1091 | 1350 | 1056 | 7 | Comparative Example |
| 82 | AD | 98 | 0 | 2 | 404 | 62 | 1226 | 1481 | 1461 | 3 | Inventive Example |
| 83 | AE | 98 | 0 | 2 | 474 | 65 | 1243 | 1489 | 1472 | 2 | Inventive Example |
| 84 | AF | 98 | 0 | 2 | 403 | 57 | 1230 | 1475 | 1463 | 2 | Inventive Example |
| 85 | AG | 98 | 0 | 2 | 330 | 58 | 1246 | 1493 | 1477 | 3 | Inventive Example |
| 86 | AH | 98 | 0 | 2 | 407 | 60 | 1239 | 1480 | 1471 | 4 | Inventive Example |
| 87 | AI | 98 | 0 | 2 | 371 | 61 | 1242 | 1499 | 1489 | 4 | Inventive Example |
| 88 | AJ | 98 | 0 | 2 | 443 | 63 | 1250 | 1507 | 1497 | 2 | Inventive Example |
| 89 | AK | 98 | 0 | 2 | 401 | 68 | 1252 | 1519 | 1510 | 3 | Inventive Example |

M: Area fraction of martensite,

F: Area fraction of ferrite,

Others: Area fraction of other metal phases

*1: The ratio of the dislocation density in the metal phases on the surface of the steel sheet to the dislocation density in the metal phases in the thicknesswise central portion of the sheet (the dislocation density in the metal phases on the surface of the steel sheet/the dislocation density in the metal phases in the thicknesswise central portion of the sheet).

In the present Example, a steel sheet was rated pass when the TS was 750 MPa or more, the critical load stress was equal to or more than the YS, and the maximum amount of warpage was 15 mm or less and shown as Inventive Example in Table 6 or 7. However, a steel sheet was rated fail when at least one of the above conditions was not satisfied and shown as Comparative Example in Table 6 or 7.

Example 3

The steel sheet No. 1 in Table 6 in Example 2 was subjected to press-forming to produce a member in an Inventive Example. Moreover, the steel sheet No. 1 in Table 6 in Example 2 and the steel sheet No. 2 in Table 6 in Example 2 were joined together by spot welding to produce a member in another Inventive Example. These members in the Inventive Examples had high strength, excellent shape uniformity, and excellent delayed fracture resistance. It was therefore found that these members can be preferably used for automotive parts etc.

REFERENCE SIGNS LIST

10 steel sheet

11*a* roll

11*b* roll

12 cooling water

A1 inter-roll distance between two rolls

D1 conveying direction of steel sheet

The invention claimed is:

1. A steel sheet comprising a steel microstructure containing:

in area fraction, martensite: from 20% to 100%, ferrite: from 0% to 80%, and another metal phase: 5% or less; and in which a ratio of a dislocation density in metal phases on a surface of the steel sheet to a dislocation density in the metal phases in a thicknesswise central portion of the steel sheet is from 30% to 80%, wherein the maximum amount of warpage of the steel sheet when the steel sheet is sheared to a length of 1 m in a rolling direction is 15 mm or less.

2. The steel sheet according to claim 1, having a chemical composition containing, in mass %, C: from 0.05% to 0.60%, Si: from 0.01% to 2.0%, Mn: from 0.1% to 3.2%, P: 0.050% or less, S: 0.0050% or less, Al: from 0.005% to 0.10%, and N: 0.010% or less, with the balance being Fe and incidental impurities.

3. The steel sheet according to claim 2, wherein the chemical composition further contains at least one selected from following groups A to E consisting of:

Group A: in mass %, at least one selected from

Cr: 0.20% or less,

Mo: less than 0.15%, and

V: 0.05% or less;

Group B: in mass %, at least one selected from

Nb: 0.020% or less and

Ti: 0.020% or less;

Group C: in mass %, at least one selected from

Cu: 0.20% or less and

Ni: 0.10% or less;

Group D: in mass %,

B: less than 0.0020%;

Group E: in mass %, at least one selected from

Sb: 0.1% or less and

Sn: 0.1% or less.

4. A member prepared by subjecting the steel sheet according to claim 1 to at least one of forming and welding.

5. A member prepared by subjecting the steel sheet according to claim 2 to at least one of forming and welding.

6. A member prepared by subjecting the steel sheet according to claim 3 to at least one of forming and welding.

7. A method for producing a steel sheet according to claim 2, the method comprising:

a hot rolling step of heating a steel slab having the chemical composition and then hot-rolling the steel slab; and an annealing step of holding a hot-rolled steel sheet obtained in the hot rolling step at an annealing temperature equal to or higher than $A_{C1}$ temperature for 30 seconds or longer, then starting water quenching the hot-rolled steel sheet from a temperature equal to or higher than Ms temperature including water cooling to 100° C. or lower, and reheating the hot-rolled steel sheet to from 100° C. to 300° C., wherein, in a region in which a surface temperature of the steel sheet is equal to or lower than (Ms temperature+150° C.) during the water cooling in the water quenching in the annealing step, the steel sheet is restrained from front and back sides of the steel sheet using two rolls such that the following conditions (1) to (3) are satisfied, the two rolls being disposed with the steel sheet interposed therebetween:

(1) a depression amount of each of the two rolls is more than t mm and (t×2.5) mm or less, where t is a thickness of the steel sheet;

(2) Rn and m are from 50 mm to 1000 mm, where Rn and rn are roll diameters of the respective two rolls; and (3) an inter-roll distance between the two rolls is more than (Rn+m+t)/16 mm and (Rn+rn+t)/1.2 mm or less.

8. A method for producing a steel sheet according to claim 3, the method comprising:

a hot rolling step of heating a steel slab having the chemical composition and then hot-rolling the steel slab; and an annealing step of holding a hot-rolled steel sheet obtained in the hot rolling step at an annealing temperature equal to or higher than $A_{C1}$ temperature for 30 seconds or longer, then starting water quenching the hot-rolled steel sheet from a temperature equal to or higher than Ms temperature including water cooling to 100° C. or lower, and reheating the hot-rolled steel sheet to from 100° C. to 300° C., wherein, in a region in which a surface temperature of the steel sheet is equal to or lower than (Ms temperature+150° C.) during the water cooling in the water quenching in the annealing step, the steel sheet is restrained from front and back sides of the steel sheet using two rolls such that the following conditions (1) to (3) are satisfied, the two rolls being disposed with the steel sheet interposed therebetween:

(1) a depression amount of each of the two rolls is more than t mm and (t×2.5) mm or less, where t is a thickness of the steel sheet;

(2) Rn and m are from 50 mm to 1000 mm, where Rn and rn are roll diameters of the respective two rolls; and (3) an inter-roll distance between the two rolls is more than (Rn+m+t)/16 mm and (Rn+m+t)/1.2 mm or less.

9. A method for producing a steel sheet according to claim 2, the method comprising:

a hot rolling step of heating a steel slab having the chemical composition and then hot-rolling the steel slab;

a cold rolling step of cold-rolling a hot-rolled steel sheet obtained in the hot rolling step; and an annealing step of holding a cold-rolled steel sheet obtained in the cold rolling step at an annealing temperature equal to or higher than $A_{C1}$ temperature for 30 seconds or longer, then starting water quenching the cold-rolled steel sheet from a temperature equal to or higher than Ms temperature including water cooling to 100° C. or lower, and reheating the cold-rolled steel sheet to from 100° C. to 300° C., wherein, in a region in which a surface temperature of the steel sheet is equal to or lower than (Ms temperature+150° C.) during the water cooling in the water quenching in the annealing step, the steel sheet is restrained from front and back sides of the steel sheet using two rolls such that the following conditions (1) to (3) are satisfied, the two rolls being disposed with the steel sheet interposed therebetween:

(1) a depression amount of each of the two rolls is more than t mm and (t×2.5) mm or less, where t is a thickness of the steel sheet;

(2) Rn and m are from 50 mm to 1000 mm, where Rn and rn are roll diameters of the respective two rolls; and (3) an inter-roll distance between the two rolls is more than (Rn+m+t)/16 mm and (Rn+m+t)/1.2 mm or less.

10. A method for producing a steel sheet according to claim 3, the method comprising:

a hot rolling step of heating a steel slab having the chemical composition and then hot-rolling the steel slab;

a cold rolling step of cold-rolling a hot-rolled steel sheet obtained in the hot rolling step; and an annealing step of holding a cold-rolled steel sheet obtained in the cold rolling step at an annealing temperature equal to or higher than $A_{C1}$ temperature for 30 seconds or longer, then starting water quenching the cold-rolled steel sheet from a temperature equal to or higher than Ms temperature including water cooling to 100° C. or lower, and reheating the cold-rolled steel sheet to from 100° C. to 300° C., wherein, in a region in which a surface temperature of the steel sheet is equal to or lower than (Ms temperature+150° C.) during the water cooling in the water quenching in the annealing step, the steel sheet is restrained from front and back sides of the steel sheet using two rolls such that the following conditions (1) to (3) are satisfied, the two rolls being disposed with the steel sheet interposed therebetween:

(1) a depression amount of each of the two rolls is more than t mm and (t×2.5) mm or less, where t is a thickness of the steel sheet;

(2) Rn and m are from 50 mm to 1000 mm, where Rn and rn are roll diameters of the respective two rolls; and (3) an inter-roll distance between the two rolls is more than (Rn+m+t)/16 mm and (Rn+m+t)/1.2 mm or less.

11. A method for producing a member, the method comprising a step of subjecting the steel sheet produced by the steel sheet production method according to claim 7 to at least one of forming and welding.

12. A method for producing a member, the method comprising a step of subjecting the steel sheet produced by the steel sheet production method according to claim 8 to at least one of forming and welding.

13. A method for producing a member, the method comprising a step of subjecting the steel sheet produced by the steel sheet production method according to claim 9 to at least one of forming and welding.

14. A method for producing a member, the method comprising a step of subjecting the steel sheet produced by the steel sheet production method according to claim 10 to at least one of forming and welding.

* * * * *